US006607157B1

(12) United States Patent
Duescher

(10) Patent No.: US 6,607,157 B1
(45) Date of Patent: Aug. 19, 2003

(54) AIR BEARING SYSTEM WITH AN AIR CYLINDER WEB DANCER SYSTEM OR IDLER ROLLS

(75) Inventor: Wayne O. Duescher, Roseville, MN (US)

(73) Assignee: Keltech Engineering, Inc., Shoreview, MN (US)

( * ) Notice: Subject to any disclaimer, the term of this patent is extended or adjusted under 35 U.S.C. 154(b) by 0 days.

(21) Appl. No.: 09/353,261

(22) Filed: Jul. 14, 1999

(51) Int. Cl.[7] ..... B65H 20/32
(52) U.S. Cl. ..... 242/417.3
(58) Field of Search ..... 242/417.3

(56) References Cited

U.S. PATENT DOCUMENTS

| | | | | | |
|---|---|---|---|---|---|
| 3,995,791 | A | | 12/1976 | Schoppee | 242/58.1 |
| 4,028,783 | A | | 6/1977 | Buck | 29/117 |
| 4,045,098 | A | * | 8/1977 | Blondeel | 308/9 |
| 4,188,257 | A | | 2/1980 | Kirkpatrick | 156/504 |
| 4,373,672 | A | * | 2/1983 | Morishita et al. | 239/703 |
| 4,603,458 | A | * | 8/1986 | Hirohata | 29/130 |
| 4,643,300 | A | | 2/1987 | Morrison | 198/842 |
| 4,645,071 | A | | 2/1987 | Faulkner et al. | 198/842 |
| 4,930,907 | A | * | 6/1990 | Smith | 384/118 |
| 5,554,262 | A | * | 9/1996 | Turner | 242/417.3 |
| 5,571,244 | A | * | 11/1996 | Andres | 123/231 |
| 5,709,352 | A | | 1/1998 | Rogers et al. | 242/417.1 |
| 5,791,541 | A | | 8/1998 | Jitsuishi et al. | 226/40 |
| 5,810,236 | A | | 9/1998 | Yoshida et al. | 226/118.3 |
| 5,982,128 | A | * | 11/1999 | Lee | 318/568.16 |
| 5,990,587 | A | * | 11/1999 | Shimanovich et al. | 310/80 |
| 6,067,778 | A | * | 5/2000 | Yamamoto et al. | 242/417.3 |

FOREIGN PATENT DOCUMENTS

| | | | | |
|---|---|---|---|---|
| JP | 401284425 | * | 11/1989 | 242/417.3 |
| JP | 402023143 | * | 1/1990 | 242/417.3 |
| JP | 404354764 | * | 12/1992 | 242/417.3 |

* cited by examiner

*Primary Examiner*—Emmanuel M. Marcelo

(57) ABSTRACT

A movable shaft with fluid bearing low friction support for the movable shaft comprises a housing, where the housing contains a shaft, at least one fluid bearing adjacent a surface of the shaft, a source of fluid at a pressure of at least 16.7 psi into the at least one fluid bearing, at least one vent for carrying fluid from the shaft to a reduced pressure area, and at least one fluid pressure chamber at one end of the shaft. The fluid pressure chamber providing fluid pressure that provides a force along an axial direction of the shaft to move the shaft axially. The shaft may be used, for example, in a roller comprising a shaft secured to a roller shell (the shaft extending out from both ends of the roller shell), hubs at each end of the shaft (each hub with air bearings within each hub adjacent to said shaft to support radial force loads on the shaft), and at least one hub having an axial movement restraint system selected from the group consisting of a flat surface bearing contact with a shaft end and a flat surface air bearing contact with an end of the roller. The shaft may also be used in a web dancer or any other device where low friction linear mechanical movement is desired.

39 Claims, 30 Drawing Sheets

A.)

B.)

AIR BEARING SYSTEM WITH AN AIR CYLINDER WEB DANCER SYSTEM OR IDLER ROLLS

BACKGROUND OF THE INVENTION

1. Field of the Invention

The present invention relates to air bearings, novel constructions using air bearings, and novel methods using the air bearings and the constructions using them. In particular, the present invention relates to air cylinder systems, web dancer systems, and idler rolls using air bearings as an essentially frictionless implementation of movement between mechanical elements.

2. Background of the Invention

Friction between moving parts still provides one of the underlying engineering problems in the construction of mechanical elements. Friction not only induces wear on parts and materials in apparatus, but also decreases the accuracy and consistency of many mechanical devices. For example, in laser printing apparatus, even though the focus of the laser beam can be reduced in size and time controls are available for accuracy less than milliseconds, the mechanical movement of elements is hampered by friction and the attendant vibrations and irregularities introduced onto the apparatus and writing surfaces. Additionally, friction causes wear in moving parts and the variations in mechanical accuracy significantly increase with time. Wear on moving parts or on parts in contact with a moving part can necessitate regularly part replacement and down time for the equipment while the part is being replaced.

Many different contributions have been made over the years towards reducing friction between moving elements. The earliest efforts were directed towards providing smoother surfaces in contact with each other, either by improved mechanical milling, grinding or lapping, or by the application of lubricant between moving surfaces. The use of the wheel or ball bearing is another way used to reduce friction between surfaces. Mechanical bearings have ball or barrel rolling elements which have a lower friction than a bearing with elements which slide relative to each other on low friction materials such as bronze, lead, Teflon, polyethylene, or other materials. Roller bearings still require lubrication to protect the point or line contact between the spherical or cylindrical elements and their associated raceways. The lubricant is progressively squashed as a roller passes by and the shearing action present here creates friction forces and generates heat that can decompose the lubricant and/or damage the bearing surface. Some precision bearings have oversized balls installed into runways to eliminate the gaps between the ball and the raceway. This reduces the looseness of the bearing device. Each compressed ball generates friction forces due to the material damping characteristics of the ball construction material.

U.S. Pat. No. 5,810,236 (Yoshida) describes a web accumulator using a dancer roller which is mounted on a single linear ball bearing slide assembly to replace conventional support systems which use two pivot arms or two vertical guide rods. The weight of the rolls provides the web tension which is not controlled. As compared to a near zero friction air bearing pivot arm dancer roller support, this system has substantial friction in the arm support system. Nothing is taught about the use of air bearings in a roller or any other part of the system including the use of an air bearing air cylinder to control the web tension.

U.S. Pat. No. 3,995,791 (Schoppee) describes a web accumulator system which holds a sufficient amount of web material in storage that the web may continue entering the accumulator even though it is stopped momentarily to splice another roll of web. The system consists of idler rolls and driven rolls and web tension is provided by counterweights on web roll arms and also provided by friction clutch devices. Idler rolls are supported on traveling slides but no concern is expressed for the friction introduced by the slides or the rollers or the residual friction which is present in the adjustable clutch even when the activation electrical signal is turned off.

U.S. Pat. No. 4,188,257 (Kirkpatrick) describes a web splicing mechanism which uses drive motors to accelerate the web from a new roll of material to speed match the web from a near exhausted roll of material so that the two webs may be joined with adhesive tape and the old web cut away from the new. This splicing function is done on-the-fly without the use of a web accumulator system. Many web idler rolls are used in this mechanism but no concern is expressed about the amount of friction that exists in any of these idler rolls.

U.S. Pat. No. 4,028,783 (Buck) describes a system of many abrasive coated idler rolls typically used in a printing press machine which have to be changed frequently to replace the old ink contaminated abrasive surface with new clear material. Buck uses a system of telescoped abrasive sleeves which are locked on mandrels with a keyway which allows the roll replacement to be accomplished much faster than the old system. Even though the printing press has many rolls in contact with the printed web, no concern is expressed in controlling the turning friction of each of these rolls or of the total cumulative friction of all of the rolls.

U.S. Pat. No. 4,643,300 (Morrison) describes an idler roll which has antifriction bearings to reduce the rolling friction of these rolls as used in a conveyor system to allow small diameter bearings to be used without deflection of the roll shaft by making a shaft with a hollow large diameter in the middle of the roll but where the largest bending forces take place and yet using a small diameter at the ends to allow the continued use of small bearings. The dirt seals on small diameter bearings have less frictional drag than large diameter bearings so an advantage in low friction is retained with these small bearings. This beneficial feature is not discussed as the primary focus is on maintaining low cost of the idler roll. Use of extraordinary low friction air bearings in these idler rolls is not discussed.

U.S. Pat. No. 4,645,071 (Faulkner) describes a low friction idler roll where the lubricated roller bearings are replaced with solid plastic bearings which eliminates the lubrication material which is a potential contamination source to the process where the idler roll is used. Thin roll shells are used with these rolls. When foreign material enters the lubrication passageways within the roller bearing body, these bearings tend to lock up and prevent the roll from turning. Use of low friction air bearings which tend not to contaminate and also are low friction are not considered.

U.S. Pat. No. 5,709,352 (Rogers) describes a zero web tension unwinder for gossamer web material used in cigarette manufacturing which is simpler than commercial machines which are available to accomplish unwinding of fragile web material. A web is loosely stretched horizontally under a pulsed sensor with an air jet blower nozzle which applies some windage downward force on the web to stabilize it for successful position measurement of the web. A feedback control system uses the sensor output to control an unwind motor to advance the unwind roll sufficient to obtain the desired droop of the web under the sensor. Rogers is concerned about the tension effects on the fragile web but he does not address elimination of friction within the machine components such as with the use of zero friction air bearings on idler rolls, web dancer arms and within air cylinders.

U.S. Pat. No. 5,791,541 (Jitsuishi) describes a web tension control system for paper printer machines that has two dancer systems that are force activated by air cylinders. Sensors indicate the position of the dancer pivot swing arms and send signals to web brakes and to drive motors to stabilize the web tension upstream of both a web in-feed roller and the nipped print heads. A control system monitors and controls the web tension during start-up, normal operation, web break events and shut-down. No discussion is made of the friction present in the standard air cylinders, the mechanical bearings of the dancer pivot arms and the bearings in the many web rollers present in the system.

Air bearings have been used for some time in which a thin film of air passes between the moving parts, with the layer of air acting to separate the moving parts to prevent any actual physical contact between the two adjacent surfaces of the moving parts. Generally, the thickness of the air film in an air bearing is less than 0.0005 inches thick, and due to the high air pressure within the air film, the bearing is very stiff in resisting the load-carrying forces. In fact, air bearing devices are often more stiff than their mechanical bearing counterparts.

There are basically two different types of air bearings, both of which can be used in the practice of the present invention. One is a diffusion gas source device, such as a porous carbon device (with air supplied to the separation zone by diffusion through a porous material) such as those made by the New Way Machine Component Company. Another type of air bearing is a device where air is directed through gaseous conductive vents or tubes into a thin gap between machine components and the air flow rate is stabilized by passing the high pressure air through a number of small orifice jet devices which are positioned around the periphery of the air bearing. The result is a load carrying high pressure air film which exists in the gap between the bearing members.

Air cylinders typically are constructed with O-ring seals on a rod piston which slides on or in a cylindrical housing. One end of the cylinder may be pivotally fixed to a surface, and a plunger compresses air within a chamber as it moves towards that surface within the cylinder housing. The O-ring seal merely assists in maintaining the pressure within a compression zone at one end of the cylinder.

Air bearing web dancer systems are used in web carrying or transporting systems, particularly where elimination of friction in web idler rolls is very important. This is a specialized use of air bearing cylinders.

Generally, very low friction is desired for thin, weak webs such as 0.005 inches or less or 0.001 inch or less in thickness. The composition of the web may be any substance that may be subject to damage when moved under stress, such as polymers, fibrous materials (e.g., artificial papers), ceramics papers, and particularly porous polyethylene or polypropylene film or web materials. It is also important to have very low friction for other types of webs to achieve effective coating or slitting or other processing and to assure accurate movement of transported materials.

Web dancer systems are used to control the web tension in a span of web that is being processed in web manufacturing machines or web processing machines. Another use of low friction idlers is in web dancer systems. Here a web is typically wrapped 180 degrees around a moving idler roll which is mounted on a pivot arm. This pivot arm is then activated by an air cylinder which results in the cylinder force being imparted to the web which is routed by the use of two stationary idler rolls. Rotational friction in any of the three rolls imposes added web tension to the web independent of the web tension created by the pressure controlled air cylinder. Many efforts have been made to create zero friction web dancer systems, including the use of techniques where a web is contained in a box and vacuum draws the web deep into the box and the web is routed into and out of the box by use of air turn devices. The air turn half cylinder shapes are pressurized internally with air which escapes radially through orifice holes to create an air film between the web and the air turn. As the web does not contact any of the structural components of the vacuum dancer device, no friction is imparted to affect the web tension. A disadvantage is that these devices cannot produce very high web tensions and are inherently unstable.

Idler rolls are used to provide low friction points of support of materials during transportation, particularly for transportation of elongate materials, such as fiber, yarn, sheet or film materials. A primary use of idler rolls is for web systems where continuous rolls of paper or plastic are processed through extruding or coating machines, longitudinal or cross-web stretching equipment, web coaters, inspection stations, web slitters, winders, converting equipment, and the like In addition, there is need for extra low friction rollers for use in conveyor idler roller systems. Further, many other processes require low friction idler rolls such as for routing of thin plastic filaments from extruder/spinneret systems, the coating of thin wires, the transfer of parts in assembly machines, printing presses, strand winding equipment, tape applications machines, web steering equipment, paper making equipment and other uses.

Idler rolls are used in many types of web processing equipment to route and steer continuous sheets of web through a machine. The largest forces on a roll are those perpendicular to the axis of the roll as imposed by the combination of forces from web tension as the web enters the roll and also as it exits the roll. Normally, there is a lesser force along the axis of the roll which originates from web forces induced when a web is not precisely perpendicular to the axis of a roller as the web enters or exits a roller.

When precision web tension is desired in one of these rollers (the dimensions of which are often referred to as the web span), web tension is typically established by a motor which supplies torque to a roll about which the web is wrapped with sufficient friction that the web does not slip on the surface of the driven roll. The torque applied to the roll by the motor is then transmitted to the web to produce the desired web span tension. Each web idler roll that is installed within a controlled tension web span will change this web span tension downstream of the idler due to the added rotational friction of the idler roll. This change of web tension can be critical to the successful processing of the web in that span zone. For instance, the thickness of a liquid coating applied to coating stations is changed by the tension of the web within the span which bridges across the coating station. Web tension control (for example when coating multiple layers of coating fluids on photographic imaging web material such as polyester or cellulose triacetate) is critical to successful coating. Great efforts have been made in the past using techniques such as installing roller bearings within concentric roller bearings. Also, when a magnetic tape web is slit to a very precise width, the web tension of the web that bridges the slitter head affects the final width of the magnetic tape strand. This affect occurs because the web is reduced in cross width the more it is stretched longitudinally due to high web span tension. If the tape is precisely slit to a given width while under great web tension, the tape will then relax to become oversized in width after it passes the slitter station and has its web tension relaxed prior to winding on a roll.

For use in web systems, elimination of friction in web idler rolls is very important. Generally, very low friction is desired for thin weak webs such as 0.001 inch or less thick porous polyethylene or polypropylene. It is also important to have very low friction for other types of webs to achieve effective coating or slitting or other processing.

Another use of low friction idlers is in web dancer systems. In that type of system, a web is typically wrapped 180 degrees around a moving idler roll that is in turn mounted on a pivot arm. This pivot arm is then activated by an air cylinder which results in the cylinder force being imparted to the web which is routed by the use of two stationary idler rolls. Rotational friction in any of the three rolls imposes added web tension to the web independent of the web tension created by the pressure controlled air cylinder. Many efforts have been made to create zero friction web dancer systems, including the use of techniques where a web is contained in a box and vacuum draws the web deep into the box and the web is routed into and out of the box by use of air turn devices. The air turn half cylinder shapes are pressurized internally with air which escapes radially through orifice holes to create an air film between the web and the air turn. As the web does not contact any of the components of the vacuum dancer device, no friction is imparted which affects the web tension. A disadvantage is that these devices cannot produce very high web tensions and are inherently unstable.

Idler rolls typically are designed with an external shell and a mechanical bearing at each end. These bearings are usually mechanical roller bearings and often include sleeve type sliding contact bearings. Other more sophisticated rolls employ magnetic suspension devices to eliminate contact between two given parts. Most roller bearings have mechanical seals which retain lubrication within the bearing housing and prevent foreign material from entering. Some low friction, loose fitting roller bearings are manufactured that eliminate seals which rub on the surface of the bearing and which are given low viscosity lubricants. Contamination of the roller bearing is a problem as particles act as wedge blocks between the rollers and the bearing braces.

Air bearings such as the porous carbon shell type units manufactured by New Way Machine Components, Inc. can be used to handle the radial forces on an idler roll but they do not have a way of addressing the axial thrust forces on the roll. It is therefore desirable to provide an idler roll described here handles both the radial and thrust loads on a roll with air bearing support on both the radial shaft surface and the axial end surface.

SUMMARY OF THE INVENTION

A near-zero friction linear motion air cylinder can be combined with a near-zero friction idler roll to form a near-zero friction web dancer system. Both the air cylinder and the idler roll use air bearings that provide near-zero friction movement of one machine element relative to another either with linear motion or rotary motion. This web dancer system can provide controlled web tension in a span of web without imparting extra web tension to the web due to friction of the dancer components. The same cylindrical shell type air bearing having porous (e.g., porous carbon) elements surrounding (on at least opposed or three point support) a shaft can provide either linear or rotary motion of the system components.

In addition, these same air bearing type devices can be used for the Dancer pivot arms or a dancer slide to create near-zero friction in these dancer components that may be used in conjunction with the air cylinders and the idler rolls.

There essentially is no friction in these machine motions because the component parts are separated by a very thin film of air that is introduced into the very small gap which exits between the parts by use of an air bearing device. Normally, this gap is filled with a lubricant having a viscosity much greater than air. When one component part is moved relative to another, the two parts slide relative to each other and develop a shearing force on this thin layer of high viscosity lubricant. This shearing force is the source of the friction between the two moving parts which prevents one part from moving freely relative to the other part. This friction force not only resists motion of the moving piece, but it also creates heat which will raise the temperature of the local area. The lubrication in most bearings is sealed within the bearing and is not recirculated to a cooling device, so the temperature builds to such a high level that heat is then successively transferred to other adjacent machine members by conduction, convection or radiation. An air bearing naturally provides a cool operating bearing device for a number of reasons. First, a high pressure compressed air source is used and this air expands as it is passed through the bearing. The temperature of this room temperature air is reduced proportionally to the change in pressure as a function of Boyle's Law which results in cooling air being continuously supplied to the bearing. Next, the viscosity of air is typically only about one thousandth that of a lubricating grease, so the amount of heat generated in the bearing joint is reduced by this large factor. Third, a semi-permanent lubricated bearing typically has a thin flexible plastic or metal shield which is used as a barrier to prevent debris from entering the internal structure of the bearing. To effect a complete seal, this thin shield is normally attached to one part of the bearing and rubs against the other moving portion of the bearing with some residual friction force due to this rubbing action.

BRIEF DESCRIPTION OF THE DRAWINGS

FIGS. 1*a*) and 1*d*) are cross sectional views and FIGS. 1*b*) and 1*c*) are perspective views.

FIG. 2*a*) shows a pivot arm web dancer and FIG. 2*b*) shows a linear slide web dancer.

DETAILED DESCRIPTION OF THE INVENTION

Figure 1:
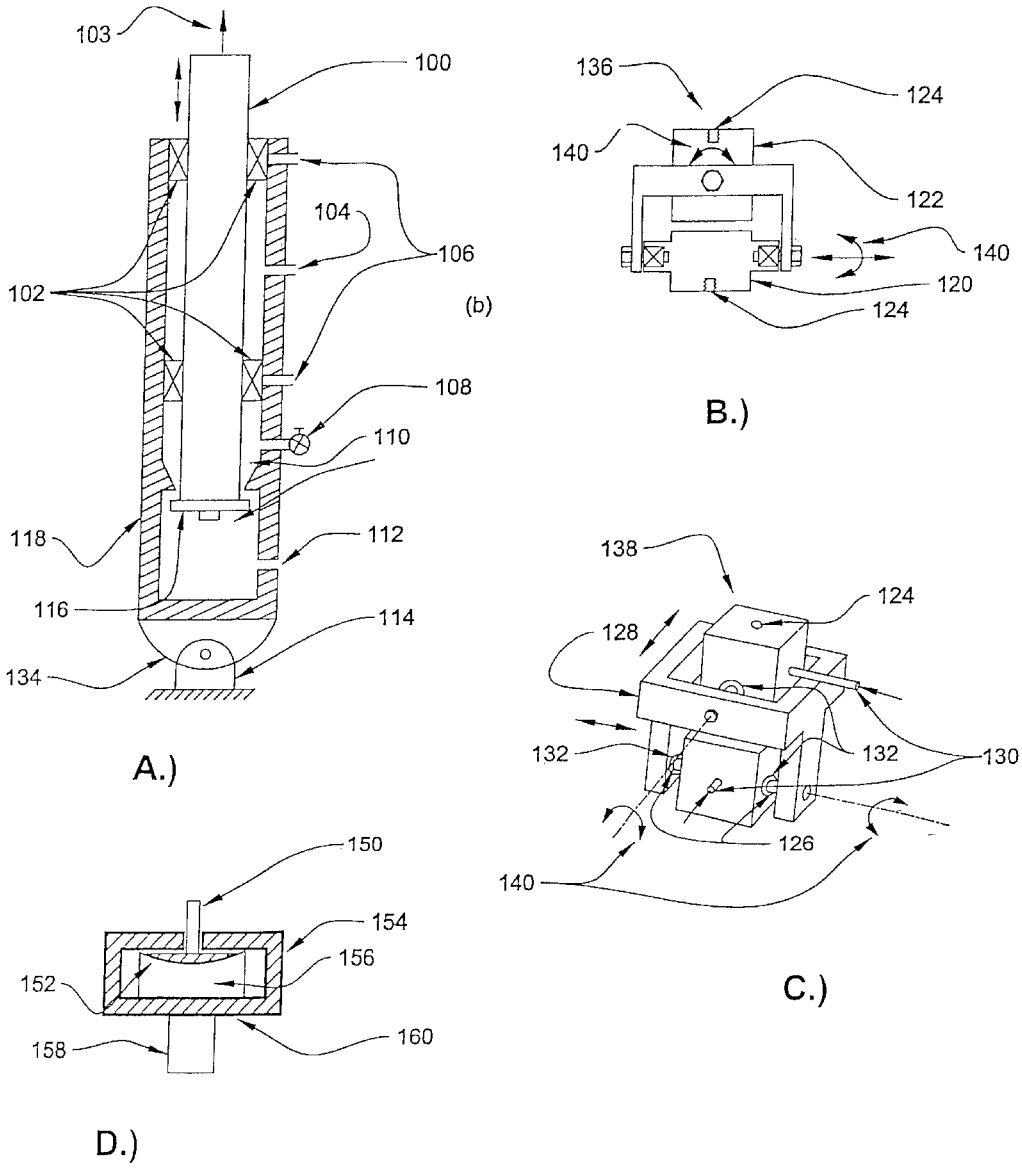
FIG. 1 has four views of a air bearing air cylinder with gimbal type support mounts.

The present invention includes a movable shaft with a low friction support for the movable shaft comprising a housing, and within the housing:

a shaft;

at least one fluid (gas or liquid, preferably gas, more preferably inert gas that does not chemically react with the composition of surfaces to which the gas comes into contact) bearing adjacent opposed surfaces of the shaft;

a source of fluid at a pressure of at least 16.7 psi into the at least one fluid bearing;

at least one vent for carrying fluid from the at least one fluid bearing away from the shaft to a reduced pressure area;

at least one fluid pressure chamber at one end of the shaft, said fluid pressure chamber being able to provide fluid pressure that provides a force along an axial direction of the shaft to move the shaft axially.

The shaft system may have the vent carry air as the fluid from the at least one fluid bearing to an ambient environment. The system may have at least one pair of opposed air bearings comprising the at least one fluid bearing. The moveable shaft system may have at least two pairs of air bearings comprise the at least one air bearing. The moveable shaft system may have at least one vent present between the at least two air bearings. The moveable shaft system may have the at least one air bearing comprising porous carbon or porous graphite air bearings to support the shaft on a film of air. The moveable shaft system may have the fluid bearing comprise an air bearing comprising orifice jets with orifice diameters ranging from 0.001 to 0.010 inches to support the shaft on a film of air. The liquid may be provided to said at least one fluid bearing to support said shaft. An adjustable orifice exhaust vent may be fluid conductively connected to said pressure chamber. A pressure regulator may regulate air pressure such that air pressure present at a cross sectional area of the shaft produces a shaft force that prevents movement of the shaft in an axial direction or causes movement of the shaft in an axial direction. A pulsating pressure source may be provided to said at least one fluid bearing, said pulsating pressure source changing the applied pressure to the fluid bearings by a factor of at least 5% at frequency range of at least 5 Hertz. A vacuum source of between 1 and 29 inches mercury may be connected to an end of the shaft within the pressure chamber to generate a negative withdrawal or retraction force against the shaft so that it may be retracted by the reduced pressure within the pressure chamber. As noted later herein, with its attendant benefits, the shaft may have a non-uniform shaft, varying continuously or in step-wise fashion. The shaft used may have a piston rod end located at the pressure chamber, and the piston rod end is sealed. The piston rod provides a surface against which pressure and force within the pressure chamber may be applied. In one preferred embodiment further described herein, at least one fluid vent is provided between the at least two pairs of opposed fluid bearings.

Another aspect of the present invention comprises a web dancer system comprising the moveable shaft described above with the housing having two ends, one end of the housing having said shaft project from the housing, and the other end of said housing being pivotably fixed to a surface, the portion of the shaft projecting from the housing being connected to a pivot arm. The web dancer system pivot arm has a first end and a second end, and said first end of said pivot arm pivots about a bearing. The web dancer system may have the second end of the pivot arm connected to a roller. It is preferred that at least one of the bearing and the roller comprises an air bearing or air bearing supported roller. The web dancer system may have the air bearing comprise porous carbon or porous graphite to support the piston shaft on a film of air. The air bearing may comprise a precision jeweled orifice jets with orifice diameters ranging from 0.001 to 0.010 inches to support the shaft on a film of air. The web dancer system may have the roller comprise air bearings supporting a dead-shaft idler roll at both ends.

Another web dancer system comprises the moveable shaft described above with the housing having two ends, one end having said shaft project from the housing, and the other end of said housing being pivotably fixed to a surface, the shaft projecting from said housing being connected to an air bearing slide.

A roller according to the invention may comprise:

a) a shaft secured to a roller shell, the shaft extending out from both ends of the roller shell;

b) hubs at each end of the shaft, each hub having air bearings within each hub adjacent to the shaft to support radial force loads on the shaft;

c) at least one hub having a spherical ball contacting ends of the shaft within the at least one hub thrust surface air bearings on the end of each roll shaft.

This type of roller may have pressurized air provided to the air bearings through ports in the hub. The pressurized air may be provided through a port that enters the hub along an axial path. The roller may have the air bearings selected from the group consisting of porous carbon air bearings, porous graphite air bearings, and orifice jets with orifice diameters ranging from 0.001 to 0.010 inches. Where there is a spherical ball present in the roller, the spherical ball may also contacts an air bearing surface. For example, the air bearing surface has an indentation that accepts or nests the spherical ball.

Another roller according to the present invention comprises:

a) a shaft secured to a roller shell, the shaft extending out from both ends of the roller shell;

b) hubs at each end of the shaft, each hub with air bearings within each hub adjacent to the shaft to support radial force loads on the shaft;

c) at least one hub having an axial movement restraint system selected from the group consisting of a flat surface air bearing contact with a shaft end and a flat surface air bearing contact with an end of the roller.

This type of roller may have the hub with at least one spring axially attached to the roller or the shaft. The roller may have gas fluid passages are provided through the hub, and the gas fluid passages are gas conductively connected to both air bearings adjacent the shaft and the flat surface contact air bearing. It is preferred that there is an entry gas fluid passage to said gas fluid passages comprising an axially oriented passage. Particularly, the entry gas fluid passage is approximately concentric with said shaft. The hub may have a hub shaft extending away from said shaft (e.g., along an axial distance), and a split spherical collar may support the hub shaft to a brace so that the hub shaft and split spherical collar may rotate within said brace. This enables the brace to be rigidly attached to any surface, yet allow the roller to be angularly adjusted (even inadvertently) with respect to that surface without affecting the performance of the roller. The brace may be tightened about the split spherical collar to reduce the ability of the split collar to move within the brace, as with bolts, screws, threaded fasteners, snaps, coil tightening mechanisms or other conventional physical tightening or clamping mechanisms.

Figure 5:
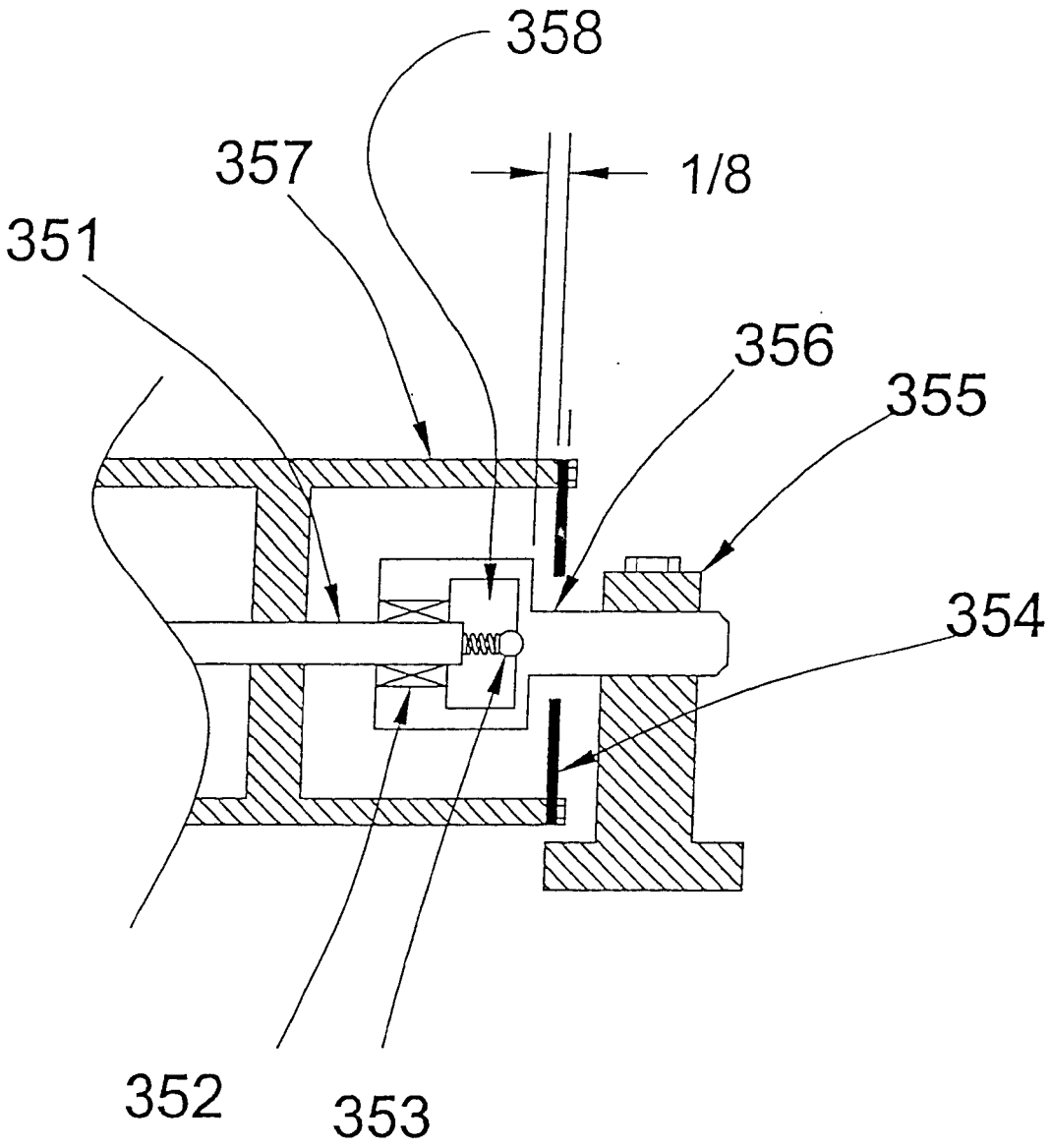
FIG. 5 is a cross sectional view of an air bearing idler roll.

A low friction roller shown in FIG. 5, for example, may comprise:

a hollow roller body 349;

an extension 357 on the hollow roller body 349;

a shaft 351 fixed to the hollow roller body (e.g., through internal member 359);

a hub 360 surrounding the shaft 351;

an air bearing system 352 supporting the shaft 351 within the hub 360;

the hub 360 having an external surface 361 facing away from the roller 349;

the extension of the roller 357 having removable retainers 354 extending inwardly;

the removable retainers 354 extending radially beyond outer limits of the external surface 361 of the hub 360, so that if the roller body 349 shifts axially with respect to the hub 360, the removable retainers will limit movement of the roller body 349 with respect to the hub 360.

Air Bearings/Air Cylinders

In many technical fields, it is desirable to have or use an air cylinder that has little or no friction about the axially moving cylinder shaft. Present low friction cylinders employ rod pistons which have flexible O-rings or other seals which are in dragging contact with the inner diameter of the cylinder walls or they use rolling bellow diaphragms of flexible rubber or plastic material. This dragging of the O-ring creates friction or stiction as does the piston rod, which drags on a cylinder rod end bushing. Rolling and unrolling of rubber diaphragms creates friction when the roll end moves and cylinders with this type of seal have limited, short strokes of motion. It takes a force or a range of force measured in ounces to pounds to break the stiction force when starting movement of a cylinder piston rod. This type of large initial force with a subsequent different force is referred to as a hysteresis force, and is a source of difficulty when a piston O-ring cylinder is used for web handling dancer systems to take up web tension. Also high friction cylinders, even rolling diaphragm cylinders, have undesirable high friction for use on applications employing slide mechanisms that have a variety of application functions such as to hold or position or move component parts, devices, mechanical testing machines, medical examination test devices and so on.

In the present invention, it is possible to create an air cylinder with the use of air bearings that radially support the piston rod shaft within the cylinder housing so that a film of air or other fluid separates the rod from the cylinder body. The device may be designed so that an adjustable air supply regulator can then apply the desired air pressure to the free end of the piston contained within the cylinder body so a force is created on the rod axially on its cross section area. A larger diameter cylinder rod, which acts as a piston, produces a larger cylinder force. The piston rod can be supported by one or two or more air bearings comprised of porous carbon, such as those purchased from New Way Machine Components Inc. such as S301901, a 0.75 inch diameter air bearing which will generate an actuating force of approximately 13 pounds at 30 psi air pressure. Likewise a 3 inch diameter New Way S307501 air bearing will generate 212 pounds of force at 30 psi. Generally, 60 psi air is applied to the air bearings with about 30 psi pressure drop occurring across the thickness of the porous carbon air bearing shell and the remaining 30 psi is available to act as a support of the piston shaft as it is centered within the air bearing shell. This allows up to 30 psi to be applied to the bottom cross-sectional surface area of the piston shaft to produce a piston actuation force. More air pressure can be supplied to the air bearing to allow higher air pressure being applied to the end of the piston shaft. Air bearings that use porous graphite shells typically have very small air passages with effective diameters of 0.1 to 10 microns. These small passages can easily be blocked with foreign particles or water vapor typically present in commercial compressed air systems. 0.1 to 5 micron filters and desiccant or other air dryers are typically used for air supplied to porous carbon air bearings An alternative air bearing design would be to replace the porous carbon air bearing with an air support system where the piston rod may be surrounded by jeweled orifice air jets such as Bird Precision Company RB-84032-0.004 jets having a 0.004 inch diameter orifice hole. These jets are somewhat more forgiving for compressed supply air filtering and drying. Usually, the cylinder piston shaft would be supported by a minimum of three jeweled orifice jets spaced at, for example, angle increments between 30 and 180 degrees, such as 120 degree angle increments around the shaft circumference. Many more of the orifice jets can be employed with perhaps 21 each or more are used to assure equalized air pressure is supplied around the shaft at the bearing section. An air pressure regulator can supply the desired air activation pressure and contain a pressure relieving functionality to accommodate leakage air from the air bearings. In place of the supply regulator, an option would be use a bleeder air orifice device to exhaust the air originating from the sir bearing, yet maintaining a desired level of pressure or specific pressure in the air chamber at the cross-section and end of the cylinder shaft. An option is to use a bleed air orifice to exhaust air. The piston activation pressure should be less than the air bearing pressure. A gimbal type mount may be used on either or both ends of the cylinder.

The air flow rate into porous carbon bearings is very small, so it is easily compensated for by a good manual or electrical air pressure supply regulator without rapidly altering the pressure within the gas supporting layer in the air cylinder. These regulators can either exhaust excess air or supply make-up air to a machine component device or a process. Thus, the leakage air originating from an air bearing that enters the pressurized air bearing cylinder piston shaft activation chamber can be easily compensated for by the regulator in maintaining an accurate set-point pressure. Creation of a force on a cylinder shaft is a function of the air pressure at the contained end of the piston shaft with very little, if any, effect from the air bearing leakage shear forces of air moving along the surface of the bearing contained portion of the piston shaft. An option exists to use an air flow orifice flow control device to bleed off air from the piston pressure chamber to the ambient environment. Air would be bled off at a rate somewhat equal to the air entering from the bearing to assure that the pressure regulator only has to supply air rather than exhaust it. An example of an air bearing that would be typically used in this application is an S301901 New Way Machine Components, Inc., ¾ inch inside diameter air bearing. This commercially available air bearing has a an air flow rate of only 6.0 cubic feet of air per hour when 60 pounds per square inch of air pressure is applied to a surface of the bearing. It therefore can be seen that the functional performance demands on a control regulator would be very small. In addition, the air bearing leakage flow into the piston rod activation chamber is less than one half of the total bearing leakage air flow as most of this air preferentially leaks in the opposite direction to a bleed vent with little or no back pressure.

A further way to reduce friction in this air bearing cylinder would be to apply pulsed air pressure to the air bearing to break any frictional contact of the piston shaft in a manner similar to how vibration is applied to component parts when moving them in a near frictionless way. Frequencies can vary, for example, from 5 Hertz (cycles per second) to 500 Hertz or greater (e.g., 2000 or 3000 or more) and the amount the pressure is varied can range from a small 5% reduction in pressure up to 75% reduction or more to help break away from the components parts, such as the cylinder rod shaft, yet nominally maintain the shaft on a film of air.

Nominally, this type of air bearing cylinder is a "push" only device, where a force is generated to force the shaft to extend from the cylinder housing, but the shaft will not pull back (retract) into the cylinder housing. However, this retraction capability can be added by simply supplying vacuum (negative pressure) of up to 28.5 inches of mercury to the piston activation chamber instead of positive air pressure.

Special design configurations of this air bearing cylinder can be configured to create unique functional characteristics. For instance, the piston rod may have different diameters on the common rod shaft (e.g., by smooth transition or by steps of different diameters) with associated equivalent sized air bearings. The axial thrust force of the piston is only affected by the diameter of the piston rod end located within the piston end chamber. The forward nose end-bearing can be of any diameter and does not influence axial rod thrust as the air cylinder chamber between the two bearings used to support the shaft is vent to ambient air pressure. Thus, a cylinder can be created that has large radial force capability, necessary for overhung perpendicular or large overhanging loads acting radially to the shaft axis, by using a large diameter bearing at the nose and yet the cylinder has a medium or low thrust by using a small diameter bearing at the piston shaft activation chamber end. Likewise, a cylinder can be constructed with a small size load capability and small radial load capability on the shaft by use of a small diameter nose bearing. Likewise, a huge shaft axial thrust capability can be attained by the use of a very large diameter shaft end chamber bearing.

Another design feature that may be practiced is to use a hollow piston shaft with the piston shaft chamber sealed to reduce the mass weight of the shaft, resulting in higher response dynamic behavior.

Air-Bearing Cylinder, Universal Joint and Spherical Rod End

Very low air friction cylinders are needed in the systems of the present invention. Even an AIRPEL™ brand cylinder exhibits significant friction on the rod bushing bearing when the piston itself has relatively low friction. AIRPEL™ brand cylinders tend to be very small in size and are fragile, with glass tube liners. Also low friction universal joints with rotational action and also translational slide action are needed to align and couple air cylinders (or other mechanisms on slides) to other mechanisms on slides, particularly where the second slides may not be parallel to the first slides.

An air cylinder (or a fluid such as a liquid or other type of gas such as nitrogen) can be constructed from air bearings contained in a cylindrical tube. A cylindrical rod may be contained by the bearings, and the cylinder rod would have a travel limiting stop plate on its end. Controlled air pressure can be introduced into a controlled pressure chamber area at the base of the cylinder and would create a force equal to the pressure multiplied by the cross-section area of the rod. High pressure air would be injected into an air bearing and this would partially exhaust into the controlled pressure area. A reducing pressure regulator would bleed this exhausted air out or an air bleed orifice would be used.

With a universal joint, the joint could be constructed of two air bearings through which round shafts are inserted and which are connected by a "Y" or "T" shaped linkage yoke. High fluid pressure (e.g., air pressure) would be fed to the air bearings. Mounting screws can be used to attach one end of the universal joint to one of the desired mechanisms at the top and the bottom block. Both rotational and sliding motion are present at both joint axes.

FIGS. 1(A), (B), (C) and (D) show one example of an air bearing cylinder A, a universal joint C (swivel bearings) and a spherical rod end D. A round piston shaft 100 is shown to move axially as restrained radially between two cylindrically shaped porous carbon air bearings 102 from the internal passage 103 of the air cylinders. High pressure air ports 106 are shown as a supply to feed pressurized air to the external periphery 107 of the air bearings 102 which pressurized air passes radially through the porous carbon air bearing shell and forms a thin film of air (not shown) between the piston shaft 100 and the bearings 102. The film of air generally is 0.001 to 0.002 inches thick and prevents physical contact of the shaft 100 with the bearings 102. An adjustable orifice valve 108 bleeds air exhausting from air bearings 102. A pressurized fluid port 112 supplies air at a regulated pressure to the cylinder chamber 110. The piston shaft 100 moves axially within the cylinder 101. The mount 114 secures the cylinder 101 and the cylinder rod stop 116 abuts against flanges 111 to prevent the piston 100 from exiting the cylinder 101 or advancing too far. The cylinder 101 pivots about the cylinder body pivot 134. Also, the cylindrical pivot 134 can be replaced with a full two axis gimbal pivot rod end assembly 160 to obtain another axis of pivoting motion. In the operation of this air cylinder, there are certain dynamic forces which appear to be unique to its operation. For example, gas (e.g., high pressure air) passes through the air bearings 102 and leaks out from underneath the bearing 102 and moves toward available vents (e.g., such as 104 and 108). If the pressure were allowed to build up within the cylinder chamber 110 below the cylinder rod stop 116, there would be no way to control the cylinder piston shaft force 103 by regulating the pressure entering from pressurized air supply vent 112, which is at a lower pressure than the fluid coming into the cylinder through the high pressure air supply 106 going to the bearings 102. To enable the air entering the cylinder chamber 110 to be at a precise regulated pressure to drive the piston shaft 100 and control the piston force 103, it is necessary to vent some of the air which is continually being released from the air bearings 102 to maintain the chamber 110 air at the desired pressure. Orifice valve 108 controls the rate of air being vented in such a way to allow the inlet pressure regulator (not shown, a conventional device controlling the pressure of inlet air) to supply sufficient air to control the chamber pressure. In this way, the entering pressure of fluid through the air bearings 102 is higher than the air pressure entering through the pressurized air or fluid supply 112 below the cylinder rod stop 116, yet the internal fluid pressure below the cylinder rod stop 116 is greater than external atmospheric pressure so that the piston shaft 100 is driven forward.

In the mechanical swivel bearing or pivot mount shown in FIG. 1*b*), the bottom block 120 of the workpiece holder (not shown in entirety) and the top block 122 of the universal joint (not shown in entirety) or air bearing gimbal pivot 138 are shown, with a mounting screw 124 shown on the bottom block 120. The top block 122 of the workpiece holder is shown with a mounting screw hole 124 and the bottom plate 120 is also shown with a mounting screw hole 124. A round shaft 126 is shown as part of the basis of axial motion 140 allowed and enabled for the universal joint 138. In the high fluid pressure swivel bearing 138 shown in FIG. 1*c*), a perspective view is provided of the universal bearing or joint 138, a "Y" yoke linkage 128 is shown connected to the top block 122 and the bottom block 120. High pressure air inlets 130 provide the pressurized air for the air bearings 132 allowing rotation between the "Y" yoke linkage 128 and the top block 122 and the bottom block 120. The air bearings 132 can also be replaced with needle bearings or other mechanical bearings to eliminate the need for a high pressure air source to operate the universal joint 138.

In FIG. 1*a*), a needle bearing gimbal pivot 134 is shown supporting the air bearing cylinder 101.

The spherical rod end assembly 160 shown in FIG. 1*d*) attaches to the free end of the piston shaft 100. This construction allows both lateral and rotational misalignment of the air cylinder 101 with the typical moving mechanical device to which it is attached. This freedom of motion of the piston shaft 100 is critical when the moving mechanical device does not move perfectly parallel to the axis of the piston shaft 100 and the shaft 100 is rigidly connected to the moving mechanical device. The air or mechanical bearing gimbal pivot 138 allows free rotation of the mounting base of the cylinder 101 and the spherical rod end assembly 160 freely allows an angular difference between the motion of the piston shaft 100 axis and the mechanism slide axis without resulting in high friction forces or large forces which would bend or damage either the cylinder 101 or the attached mechanism. An attachment shaft 150 is used to couple the rod end assembly to a typical machine mechanism and has a spherical ball end 152 which is in sliding contact with a matching spherical seat 156. Both the ball end 152 and the seat 156 are contained with limited movement within a spherical rod end assembly housing 154. The spherical seat 156 has a small amount of allowed movement radially within the assembly housing 154. A cylinder rod end coupler 158 is an integral part of the assembly housing 154 which allows attachment of the coupler 158 to the free end of the piston shaft 100.

Air Cylinder Gimbal Swivel

Friction between a piston rod and the rod end slide is very substantial even in very low friction cylinders such as the AIRPEL™ model 9E cylinders. This type of air bearing cylinder has virtually no friction on the rod piston due to the film of air between the piston and the piston cylinder wall. However, the rod slides along stationary bearing which can generate substantial sliding friction or stiction due to normal forces acting perpendicular to the rod. These forces originate when the cylinder body is held rigidly and the mechanism attached to the rod travels in a direction that is not parallel to the piston rod. A low friction air bearing slide mechanism will have more friction in the "x" and "y" directions when it slides in the "z" direction. The same relative motion occurs with other types of bearing slides.

A long air bearing cylinder with a rod travel that is much longer than the intended rod travel distance assists in reducing this problem. The cylinder is mounted with the piston positioned toward the base of the cylinder body. This assists in the rod gaining the maximum leverage to easily push the rod bearing end of the cylinder to follow the path of the slide mechanism attached to the rod end. Then a low friction u-joint type of double bearing device is attached to the base of the cylinder. Having a long cylinder body maximizes the leverage on the spherical trunnion base mounting bearing and minimizes the 90 degree "normal" force on the rod slide bearing. The use of a pivot/slide rod end coupler device is beneficial to reduce friction.

Web Dancer Air Bearing

When a web dancer system using a rotating web roll mounted on a pivot arm or a slide is used to tension a moving web, any friction or stiction in the dancer moving parts adds undesirable tension forces to the web due to these friction sources. Bearing lubricants can also contaminate medical or chemical use and require periodic maintenance.

In the present invention, a web dancer system can be made of a combination of friction free component parts, each of which can be substituted for an equivalent part presently in general use that has considerable friction or stiction. An air bearing air cylinder can be substituted for standard air cylinders and this friction free device can be used in conjunction with one or more other friction free devices. For instance, the roller or sleeve bearings mounted at the stationary ends of the pivot arm can also employ cylindrical sleeve type air bearings manufactured by New Way Machine Components. These pivot air bearings may be used with traditional roller or stationary bronze or plastic thrust bearings which would contribute a small amount of friction to the roll pivot arm action. Thrust type air bearings could also be used to replace the standard thrust bearings. Air bearing web dancers could be used in medical or chemical processing areas where lubricants would act as contaminants. No lubricant is required as pressurized air or other gases are used for bearing support. Further, the rotating web roll which spans the width of the web normally uses traditional frictional bearings which again can be replaced with air bearings for both radial and axial forces on the web roll. The dancer pivot arm could also be replaced with an air bearing supported linear slide, again which has little or no friction. The web inlet and exit dancer support rolls can also use air bearings.

Figure 2:
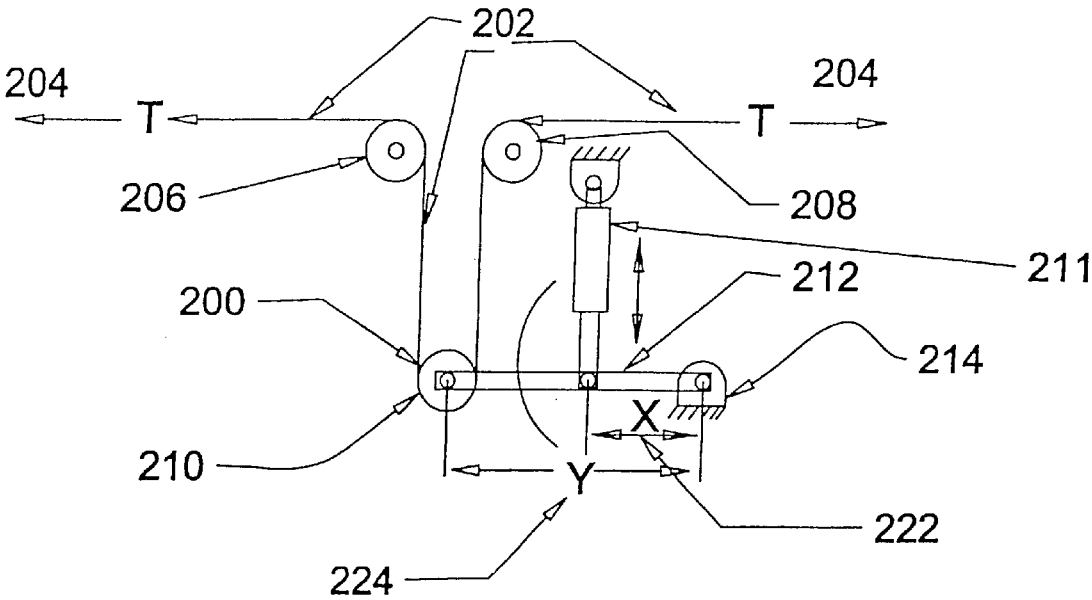
FIG. 2 is two side views of a web dancer system.
Figure 2:
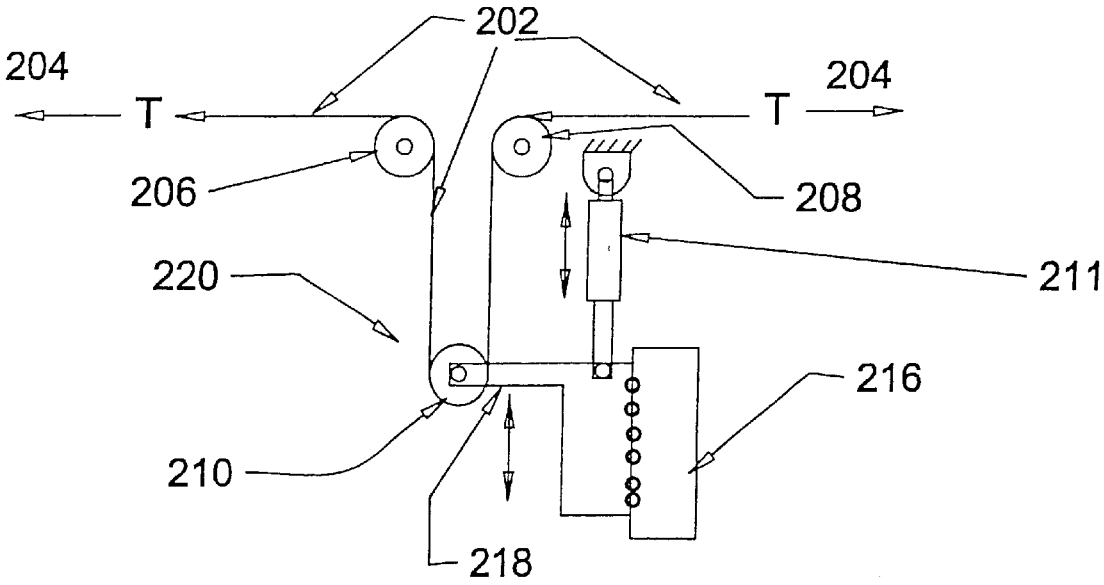

In FIG. 2, web dancer systems using an air bearing actuator cylinder are shown. FIG. 1*a*) shows a pivot type mechanism 201 and the FIG. 1*b*) shows a linear slide dancer system 203.

FIGS. 2*a*), and *b*) show two web dancer systems which employ air bearing cylinders which apply force to a freely moving web idler roll. The web may be any flexible, brittle, frangible, or weak web material, such as narrow ¼ inch wide magnetic tape, 20 inch wide polyester film, liner blanks, dry film adhesive or 120 inch wide coated pressure stick adhesive tape material. For FIG. 2*a*) the pivot arm dancer system 200 has two stationary idlers, the web exit idler roll 206 and the web inlet idler roll 208 which guide the web 202 into and out from the web dancer roll 210.

The web dancer roll 210 is mounted to a dancer pivot arm 212 which is fixed in space by the pivot arm rotatable fixed mount 214. Force is applied to the pivot arm 214 by the air bearing cylinder 211 which is attached to the arm at a point approximately half way between the arm pivot mount 214 and the dancer idler 210. Mounting the cylinder 211 closer to the dancer idler 210 produces a larger portion of the cylinder 211 thrust force on the dancer idler 210 as the arm lever ratio of cylinder pivot location "X" 222 divided by dancer idler pivot location "Y" 224 is increased. The web tension "T" 204 is a measure of the total force on the web divided by the lineal web width which is defined in terms of pounds per lineal inch. The web tension "T" 204 is created by one half of the total force on the web dancer roll 210 as there are two sections of web which act against the dancer idler 210. There is a certain amount of friction in the rotational bearings at both the pivot arm fixed mount 214 and also in the rolling bearings (not shown) installed in the web idler rolls 206 and 208. This friction can also be reduced by directly replacing these bearings with non-contact air bearing elements (not shown). Simple cylindrical air bearings from New Way Machine Components Inc. can be used to reduce or eliminate the friction of these components due to radial force loads. Axial thrust friction on these components can also be reduced by the use of air bearings supporting the axial thrust loads which are very small in a typical web dancer system.

FIG. 2(B) shows a slide dancer system 203 using a linear slide 216 in place of a pivot arm 211 to mount a web dancer roll 210. A web exit idler roll 206 and a web inlet idler roll 208 are used to route the web 202 through the slide dancer system 220. The air bearing cylinder 212 is attached directly to the slide by use of an idler mount arm 218 thus all of the cylinder actuation force is applied directly to the dancer idler roll 210. The linear slide 216 can be constructed of traditional slide bearing surfaces, roller element bearings or porous or orifice jet air bearings.

Fluid Bearing Rollers

It is desired to have rollers with no friction for many applications such as web handling rolls, conveyor rolls, and the like, that have axial thrust resisting capability and that do not produce contamination from lubricating oils or the roll component materials. Cylindrical air bearings such as those made by New Way Machine Components Company provide radial support but not axial support. It would be desirable to replace existing high friction mechanical rollers with this type of fluid bearing roll with a minimum of change in the roller mount brackets. Rolls with low inertia helps accelerate or decelerate rolls from rest to full speed. Thermal or chemical swelling growth of the roller length can create problems.

This aspect of the present invention may be practiced by making a hollow shell roll with a precision ground integral shaft to create a live-shaft roll and supporting both ends of the roll with porous carbon air or other gas bearings or supporting the ends with a pattern of orifice jets to create a high pressure gas or air film between the shaft and the fluid bearing. Fluids other than gases may be used such as low viscosity oils, solvents, water, all of which may have chemical additive included for corrosion prevention, compatibility with a process and so on, although the inert gas filled cylinders are preferred for their inability to contribute contaminants. The live shaft roll may then be restrained axially by use of another fluid bearing device that is sufficient in strength to keep the roll centered while resisting axial forces imposed by a moving web contacting a roll surface of other forces. A simple spring force loaded spherical ball can be installed within a cylindrical chamber in the end of the live roll shaft at both ends of the shaft. The spring would be selected to push the sphere ball out away from the shaft midpoint with sufficient force to resist the roll axis forces. The spring may also be mechanically damped to attenuate axial oscillations or vibrations of the roller. An outboard hub would be used to support the cylindrical air bearing and it also would have a spherical shaped cup at its centerline facing the spherical ball installed at the end of the shaft. An air passage would be made in the end of the hub that extends out beyond the hub clamp by pillow blocks. High pressure air or fluid would be directed through this air passage to both the spherical seat and the air bearing with flow to each controlled by optional use of fluid orifices. The sphere ball would nest in the spherical seat but would not contact the seat as the high pressure fluid fed to the seat would hold the ball away. A bleeder passage would be incorporated into the hub shaft to allow the fluid from the internal portion of the air bearing and the sphere seat to be exhausted to the environment. To assemble the roller, the air bearing hubs would be slipped on to the shaft ends and these hubs would in turn be mounted into pillow blocks with the desired preset force applied axially by pushing the hubs toward the roll center before clamping them tight with the end pillow blocks. The ball seat could also be of porous carbon.

Figure 3:
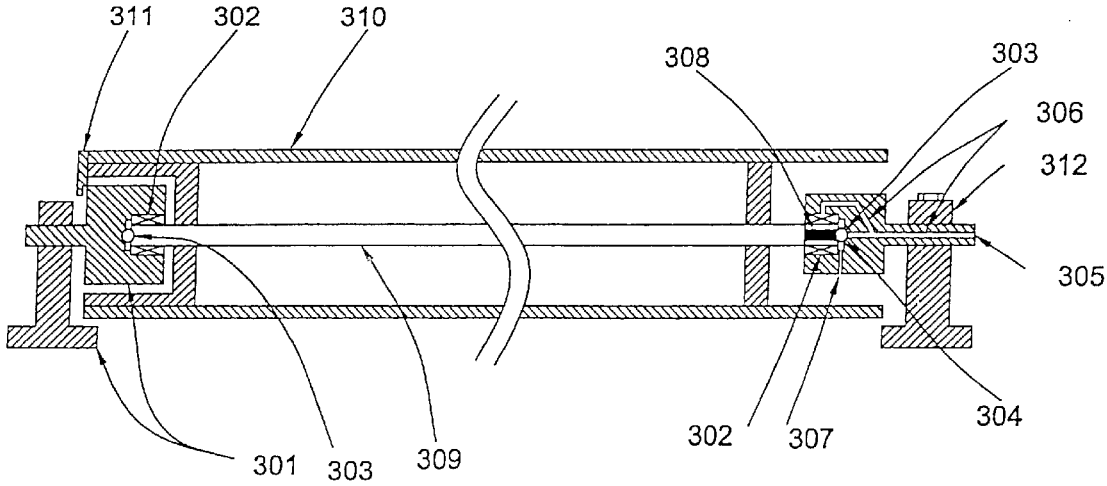
FIG. 3 is a cross sectional view of a fluid bearing roller.

FIG. 3 shows a fluid bearing roller 300 with an idler roll shaft end support hub 299 with a stationary support 301 which contains a spherical ball 303 which floats loose in a drilled out end of a "live" internal shaft 309 which rotates with a cylindrical roll shell 310 around which a web material of paper or plastic is wrapped from 5 degrees to 180 degrees. An air bearing 302 is supported as an integral part of the hub 301 and is fed high pressure air through a passageway 305 drilled into the end of the hub 301 with the air presented around the outer diameter surface of the porous carbon air bearing 302 and it passes through the bearing thickness and is directed along the surface of the shaft 309 and then is exhausted to the atmosphere through exhaust passage 307. About one half of the air pressure supplied to the outside of said bearing is expended as it passes through the bearing wall and the other half of the source air pressure is present between said bearing 302 surface and said shaft 309 which prevents said shaft 309 from contacting said bearing 302 and roller shell 310 as the roller shell is structurally coupled to the roll shaft that is surrounded by an air bearing, the shell effectively rides on a film of high pressure air which supports radial load forces applied to the roll (not shown) by a web (not shown) or other contact forces such as a heavy part being transported by a roller. Axial forces applied to said roll shell are resisted by a spherical ball 303 which is loosely contained in a spherical seat 304 to which high pressure air is fed through hub passageway 305 with the effect that a high pressure air film (not shown) develops between said ball 303 and said ball seats (315, 316) on both ends of said roll shaft. A compression spring 308 positioned in a hole 317 drilled axially into the end of said shaft 309 is used to constantly force said roll shaft [internal shaft 309] away from its roller spring 308 end of the roller shell 310 and toward the opposite end of said roll which prevents said roll from operating without axial restraint between the shaft mounting pillow blocks 312. A air flow rate control orifice 306 can be used in passageways 305 which supply high pressure air to both said ball seats 315, 316 for axial and radial shaft 309 support on a film of air and these control orifices 306 can be of different size openings to independently control the rate of air flow to the ball seat 315, 316 or to air bearing 302. The hub end restraint device 311 is attached to the outside periphery of roll shell 310 so that is not in contact with the roll hub 301 after the roll assembly is installed in a machine but yet acts to prevent the said shaft end hubs 301 from falling off the shaft 309 during shipping.

Air Bearing Idler Roll and Roller

When an air bearing idler roll has an air bearing axial restraint (such as a sphere ball supported in a sphere seat having air supplied to it by an air jet orifice system), there will be a tendency for the ball to oscillate vibrationally in the ball seat due to repeated pressure buildup and sudden release. This creates a hammering vibration that may be enhanced or made worse if the ball is held against the ball seat by a spring which would have its own natural vibration frequency, $$f_n = \sqrt{\frac{k}{m}}$$

where k=the spring constant and m=the ball mass. Where the frequencies are similar or overlap, a sympathetic vibration may even set in, significantly increasing the adverse affect. Also the ball must not be damaged when contacting the ball-seat surface or its effectiveness and benefits will be reduced. Another problem that can occur prior to or during mounting of the air bearing roll is that the roll hub may slip partly off the roll live shaft and become jammed or crooked on the shaft where the end of the roll shaft digs into the soft porous carbon surface of the air bearing and damage the air bearing. Furthermore the sphere ball must have enough radial motion capability that the ball does not limit the radial motion of the shaft in the shaft air bearing.

The axial spherical ball seat can be fabricated of a porous material (e.g., porous ceramic, porous polymer, porous carbon or porous graphite) that preferably also provides low friction and won't be damaged if the ball contacts the porous material when air pressure is lost. The porous material (e.g., carbon) bleeds out air flow constantly across its surface so there is no surging that eliminates the axial vibration. The ball can be mounted on an elastic spring device or a combination elastic/plastic spring which would damp out vibrations. Also the ball can be attached to the end of the idler roll live shaft with no self centering ball springs and with a nominal small 0.003 inch gap between the ball and the ball seat to allow for assembly variations and thermal expansion of the idler roll and shaft assembly. Furthermore, the air bearing roll outboard hubs could be loosely captured within the confines of the shell to allow a limited axial motion of each hub of perhaps about 0.05 to 2.0 mm or more to prevent the hub from sliding out toward the end of the roll and, with this limited motion, the free end of the idler shaft would be prevented from contacting the shell cylindrical air bearing porous carbon surface.

Figure 4:
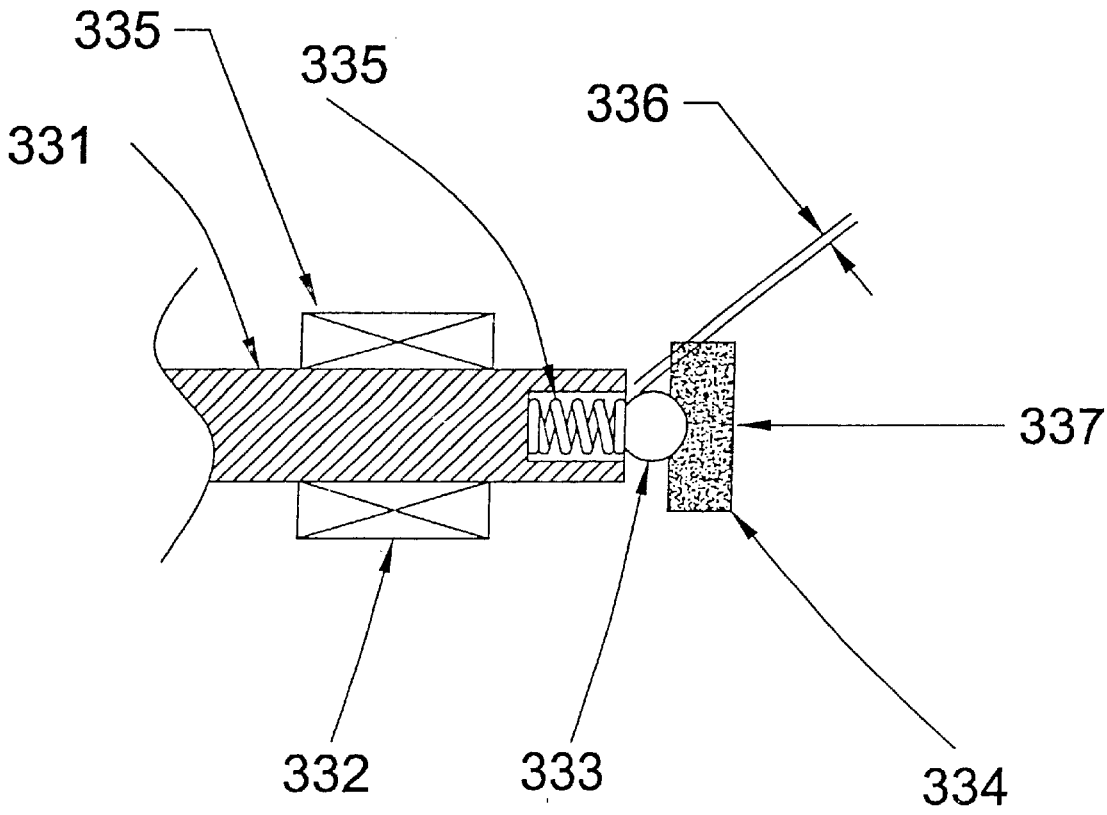
FIG. 4 is a cross sectional view of an air bearing idler roll and roller.

FIG. 4 shows an air bearing idler roll and roller 330, FIG. 4 showing just the end of an idler roll shaft 331 and not the remainder of a typical roll assembly to focus on the aspects of using a porous carbon spherical ball seat 334 which captures a spherical ball 33 which is contained at the end of a compression spring 335 which is inset into an axial hole 338 drilled into the shaft end 339. The shaft 331 is radially supported by an air gap bearing 332 by a source of high pressure air pressing against the outward surface 337. Constant axial force is simultaneously maintained on both ends of the shaft by the residual force provided by the spring 335 being compressed to the desired amount upon installation of the roller 330 in a machine by sliding the shaft support hub (not shown) axially before fixing it in place with threaded fasteners or other shaft hub end clamping means (not shown). A mechanical gap 336 is maintained between the ball 333 and the end of the shaft 331 to allow a slight radial movement of the ball 333 if the true spherical center of the ball seat 340 in the porous carbon 334 is not perfectly aligned with the axial center of the cylindrical air bearing or also to compensate for radial wear of either the air bearing 334 or the ball seat 340.

FIG. 5 shows the end portion only of an air bearing idler roll 350 which is shown to have, for example, an approximately 0.125 inch gap (e.g., about 0.05 to 2 mm) set between the contacting edge of a roll shell 357 mounted retaining ring 354 and the close edge of the roll hub 356 which is supported by pillow blocks 355. The roll shaft 351 is attached as an integral part of the roll shell 357 to prevent the shell from moving relative to the shaft 351. For assembly purposes, the retainer ring is fastened to the shell by removable fasteners (not shown, such as clips, clamps, snaps, welding, adhesives, bolts, screws, threading, etc.). Air bearings 352 support the shaft, which is axially loaded by the compression spring 358 which supports a spherical ball 353.

Air Bearing Idler Roll

Applying a zero friction axial restraint system on an air bearing idler roll shaft has a number of factors which can solve some problems but create others. For instance, using a spring loaded system on both ends of the shaft can eliminate potential binding problems caused by the axial growth of the shaft due to thermal expansion when a shaft or roll is heated. If a heated shaft expands in length, the springs will compress enough to compensate for this change in length. Here, the shaft and shell expand in length, but the shaft hubs do not move as they are attached to the machine frame. Another problem is that the idler live shaft has some radial movement in operation which can be resisted by a cup shaped axial force system which does not allow this radial motion. Both the radial support air bearing and the cup shaped axial air bearing control the radial movement of the shaft. It is not desirable that the axial cup system influence the radial centering of the shaft, but assists in keeping the air film uniform. If two spring loaded axial devices are used on each end of a shaft, there will be a tendency for the shaft to oscillate axially due to the natural frequency effect of the restraining spring constant and the mass of the shaft as governed by $$\omega_n = \sqrt{\frac{k}{m}}.$$

When a hub end is used to support the shaft end, the hub can slide off a shaft end (completely or partially) and block or jam the hub on the fragile bearing and damage the bearing. Air bearings have limited load carrying capability as compared to a mechanical ball or roller bearing for the same equivalent diameter or length, and therefore the replacement of ball or roller bearings with air bearings will lower the load capacity of the system. The configuration of a ball with a matching ball set can be difficult to manufacture accurately. Because the typical air gap film thickness of an air bearing is on the order of 0.0005 inches or less (e.g., 0.00001 to 0001), fitting flatness surface finish is very important to avoid wear of the soft carbon air bearing.

There are a number of different design features which can be employed which address one or more of the problems which exist for axial roll shaft restraint devices. These design techniques can be used alone or together to reduce these problems. Some of these design concepts are given here:

Cone Shaped Air Bearing

Figure 6:
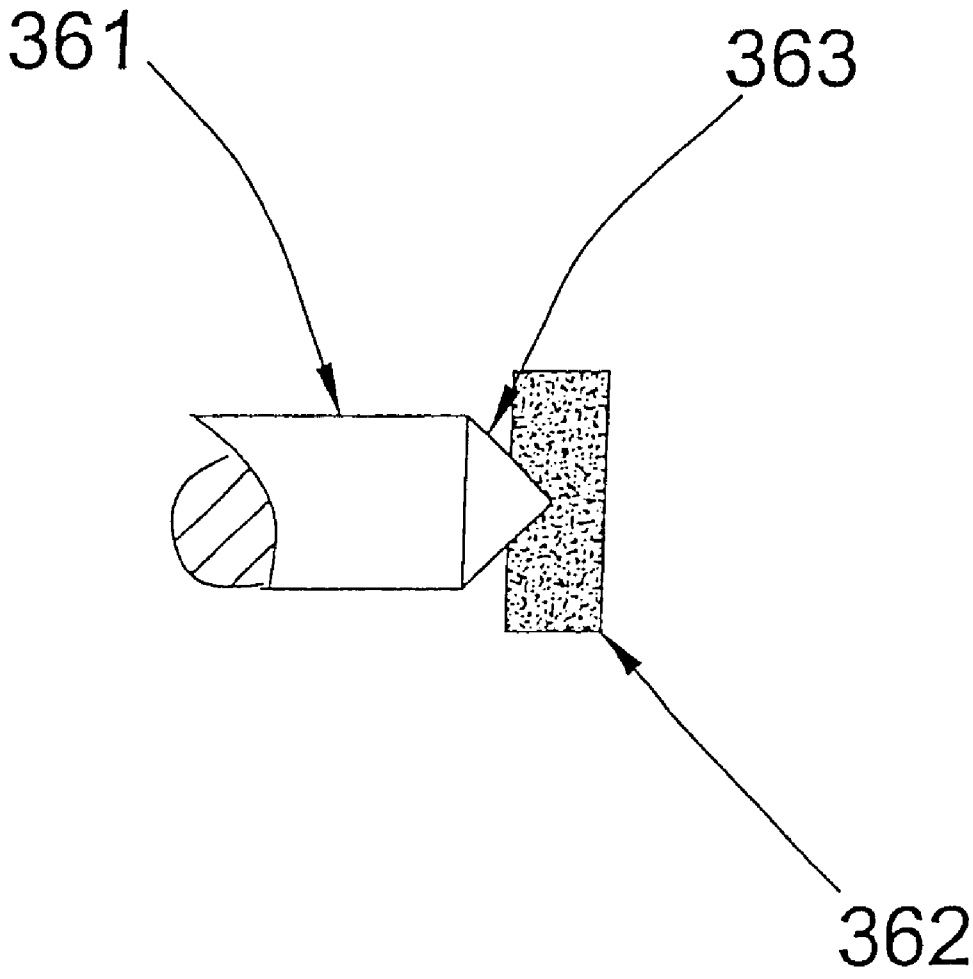
FIG. 6 is a cross sectional view of a cone shaped air bearing.

FIG. 6 shows only the end of a roll shaft 363 of an air bearing roll 360 to focus attention on the cone shape 363 of said shaft end 361 and the matching cone shaped porous carbon or air orifice jet air bearing 362. The two cone shapes match where the said shaft cone shape nests in the cone shape which is recessed into said support air bearing seat 362. As the axial separation force on shaft cone shaped end 363 has approximately the same projected surface area as a spherical ball shape, the same pressurized air film between the bearing and the shaft end will produce the same equivalent axial separation force as a spherical ball and seat configuration. Manufacturing costs of a matching cone shaped shaft end 363 and cone shaped receptor seat bearing 365 are less than the costs of producing a corresponding matching spherical ball air bearing. An alternative type of air bearing device, which employs the use of a set of orifice jets can replace the porous carbon bearing in the same matching cone shaped configuration. There are generally a set of three or more orifice jet 367 openings evenly spaced within the cone seat to generate a high support pressure air film within the bearing the same as occurs with the porous carbon air bearing.

Ball with Cone Seat

Figure 7:
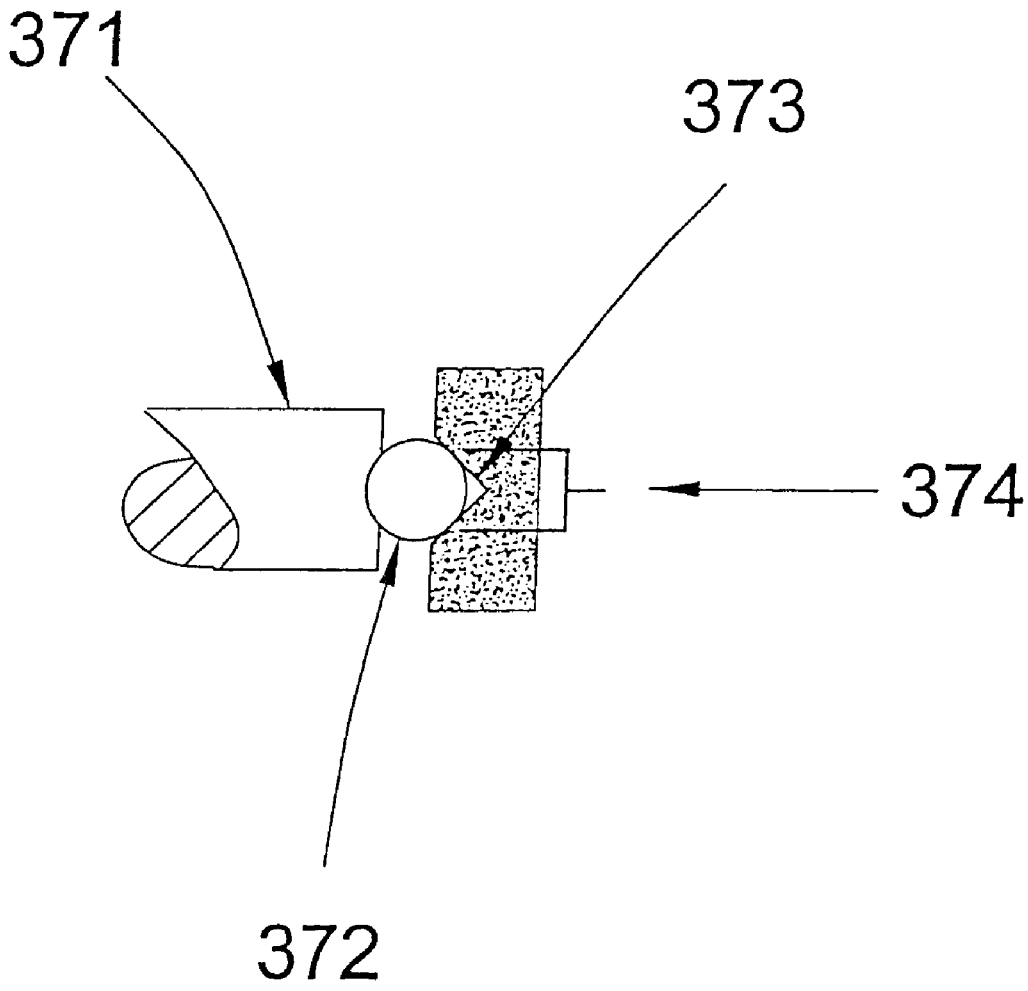
FIG. 7 is a cross sectional view of a ball with a cone seat.

FIG. 7 shows a roll shaft 371 which has a standard commercial spherical ball 372 attached to the end of the said roll shaft 371. A cone shaped porous carbon or orifice jet seat 373 is used to nest the said shaft ball 372. The axially projected high pressure surface area 374 is the area which is contained within a circle defined by the witness line where the said ball contacts the said tapered cone. The axial separation force subjected to the said ball 372 is due to the high pressure air within the air film between said ball 372 and said cone seat 373. Because of the air film separation, the ball does not physically contact the cone seat. This configuration provides a natural seal between the said ball and the said cone shaped seat and is inexpensive to manufacture a high quality axial air bearing system.

Dual Shaft Air Bearing

Figure 8:
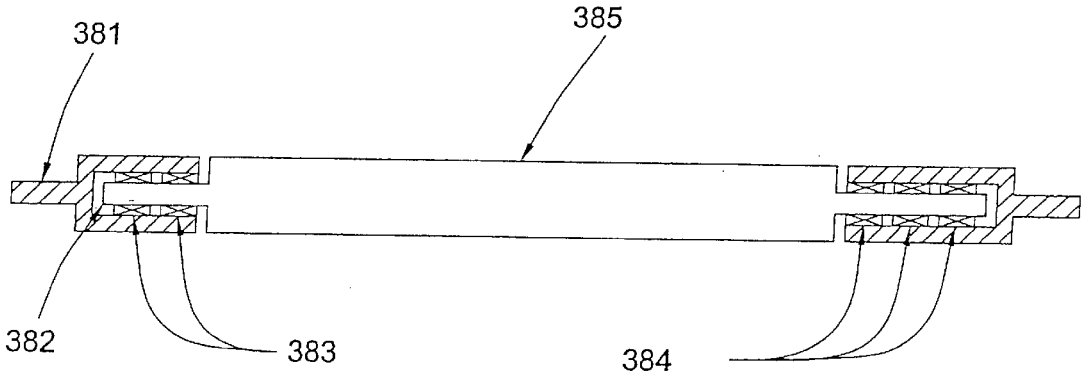
FIG. 8 is a cross sectional view of a dual shaft air bearing.

FIG. 8 shows an idler roll or roller 380 which has more than one standard diameter sized shell type porous carbon air bearing 383 used on a shaft to support a radial load than the support capabilities of a single bearing. These air bearings 383 surround the end of a roll shaft 382. Here, a roll exterior shell 385 is attached to be an integral part of said roll shaft 382. One end of the roll is shown with the radial support of a dual set of air bearings 383 and the other end of said roll shaft is shown supported by a set of three air bearings 384. The two air bearing set-up 383 would support twice the radial load as a single air bearing but the axial load carrying capability of the single bearing set-up would be the same as the two-bearing set-up 383. Likewise, the radial load capability of the three-bearing set-up 384 is three times greater than the single bearing but the axial load capability is the same. In all the cases here, the cross section area of the axial thrust bearing is the same, and therefore, the axial air bearing pressure force is the same.

Relieved Sphere Cup Seat

Figure 9:
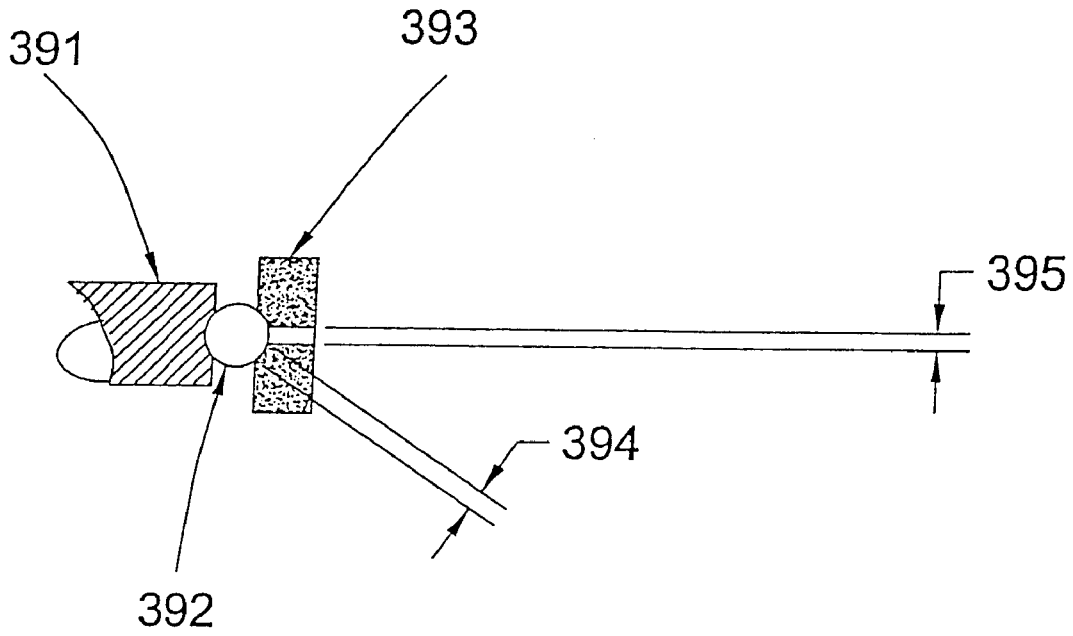
FIG. 9 is a cross sectional view of a relieved sphere cup seal.

FIG. 9 shows a shaft 391 which has a commercially available spherical ball 392 integrally attached to it by welding, cement or other means to produce a shaft with a spherical end where the center of the sphere 392 is precisely aligned with the center line of the shaft 391. The air bearing ball cup seat 393 can be formed of either porous carbon or it can be a jet orifice device which has high pressure air supplied to it to axially from a position away from the ball ended shaft. The center of the sphere cup seat 395 would be drilled out so that no bearing material resides under the ball 392 at the apex of the ball where the ball 392 contacts the bearing seat 393. The ball will only contact the bearing cup seat 393 on an annular band support area portion of the spherical interface between the ball 392 and the ball seat 393. Removing the center drilled out hole area 395 has the advantage of the ball 392 wearing into the soft porous carbon seat 393 more easily and quickly as there exists a significant relative velocity between said ball and said seat at the outer periphery of the contact area. Due to geometry considerations where the contact surface speed of a point on said ball will be proportional to the radius from the centerline of the shaft 391 with the result that there is zero relative contact velocity between the ball 392 and the bearing seat 393 at the shaft 391 centerline. Because the relative surface speed is near zero at said shaft centerline, this portion will tend not to wear-in during operation to produce the desired precision fit of the whole contact surface of said ball and said seat unless this drilled out area 395 is removed. The area removed by the drilled hole 395 may range, for example only, from 5 percent to 50 percent of the whole contact surface area between the ball and the bearing seat. Most of the axial thrust surface area will still exist to support thrust loads as most of the annular surface area exists at the outer periphery of an annular ring. This wear-in nesting of the ball 392 to the bearing seat 393 is necessary as it is very difficult to obtain perfect alignment of the shaft 391 centerline with the attached ball 392 to the centerline of the preformed spherical ball bearing seat which is attached to other hardware which is mounted together to form an axial air bearing assembly with normal cumulative machining tolerances of each involved component part. The air bearing air film which exists between the ball 392 and bearing seat 393 is typically 0.0001 to 0.001 inch thick which is the end result of matching all of these parts to form air assembly. Subsequent normal expected wear of the radial shaft 391 air bearings also cause a new wear-in fitting to the ball 392 to bearing seat 393. Further, when air orifice jets are manufactured, a rough sized spherical cup is machined, the set of air jet holes drilled radially into the spherical seat and the seat area filled with a low friction epoxy type material with using an inserted ball to set the shape of the epoxy filler material. This same epoxy would have to be worn-in the same as the porous carbon.

Floating Ball Cup Seat

Figure 10:
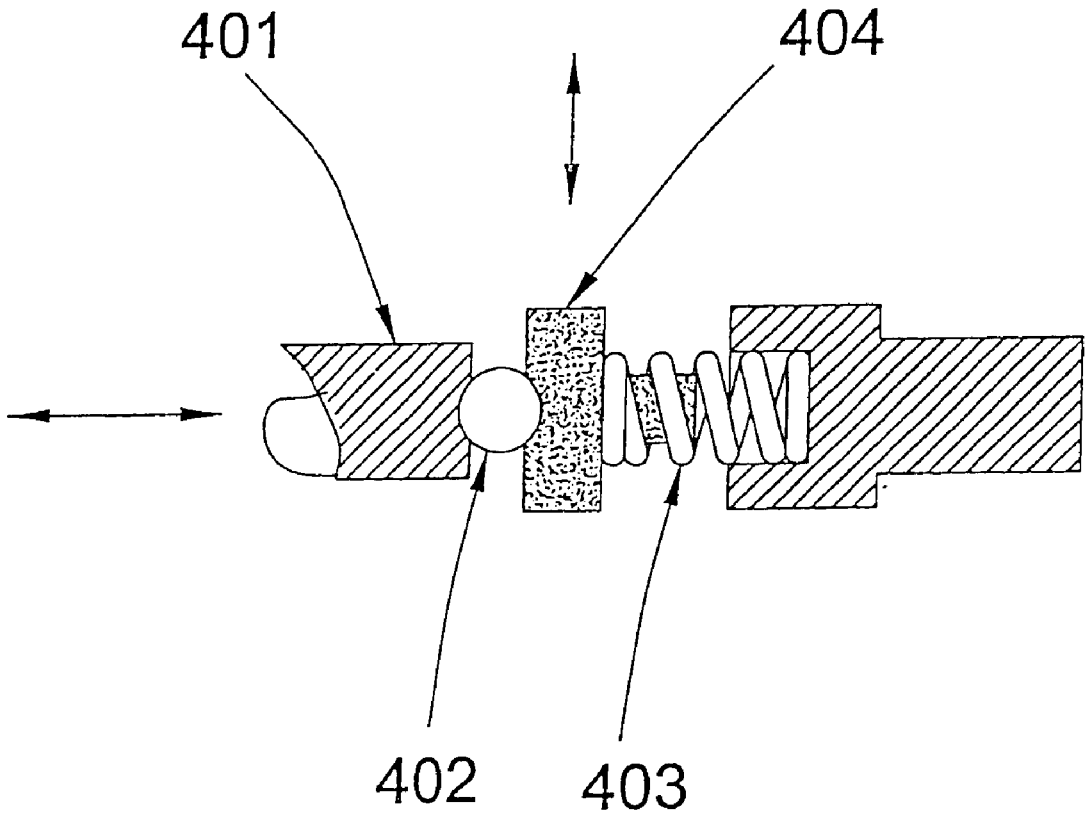
FIG. 10 is a cross sectional view of a floating ball cup seal.

FIG. 10 shows an alternative method of coupling a spherical ball ended shaft to a roll end supporting hub that provides axial thrust support and yet allows limited radial motion of the ball joint to compensate for manufacturing tolerance misalignment and also allow the misalignment which results from wear of the moving components. The roll shaft 401 supports a rotating roll shell, and the porous air bearing cup seat is held stationary by a spring 403 that is attached to a stationary hub (not identified). The ball 402 is an integral part of the shaft 401. The ball seat 404 is allowed to move radially as shown by the double sided arrow because of the column bending natural weakness of the spring. The spring is stiff enough and in a sufficiently compressed state that the lateral axial forces generated at the external surface of the roll shell (not shown) are supported adequately to limit the axial motion of the roll shell axially to an acceptable amount. The bearing seat 404 has an integral cylindrical boss over which said spring is slid to simply connect the spring 403 to the bearing seat 404. In like fashion, the opposite free end of the spring is captured by inserting it into a hole drilled in the hub.

Non Spring Loader Radial Floating Cup

Here, the high pressure air source applies air pressure to the back flat side of the air bearing cup seat with the air traveling through the porous cup material to float the ball. In addition, the air also lubricates the surface between the flat seat base and the hub base which allows radial motion of the cup seat while an axial force is maintained on the shaft.

Figure 11:
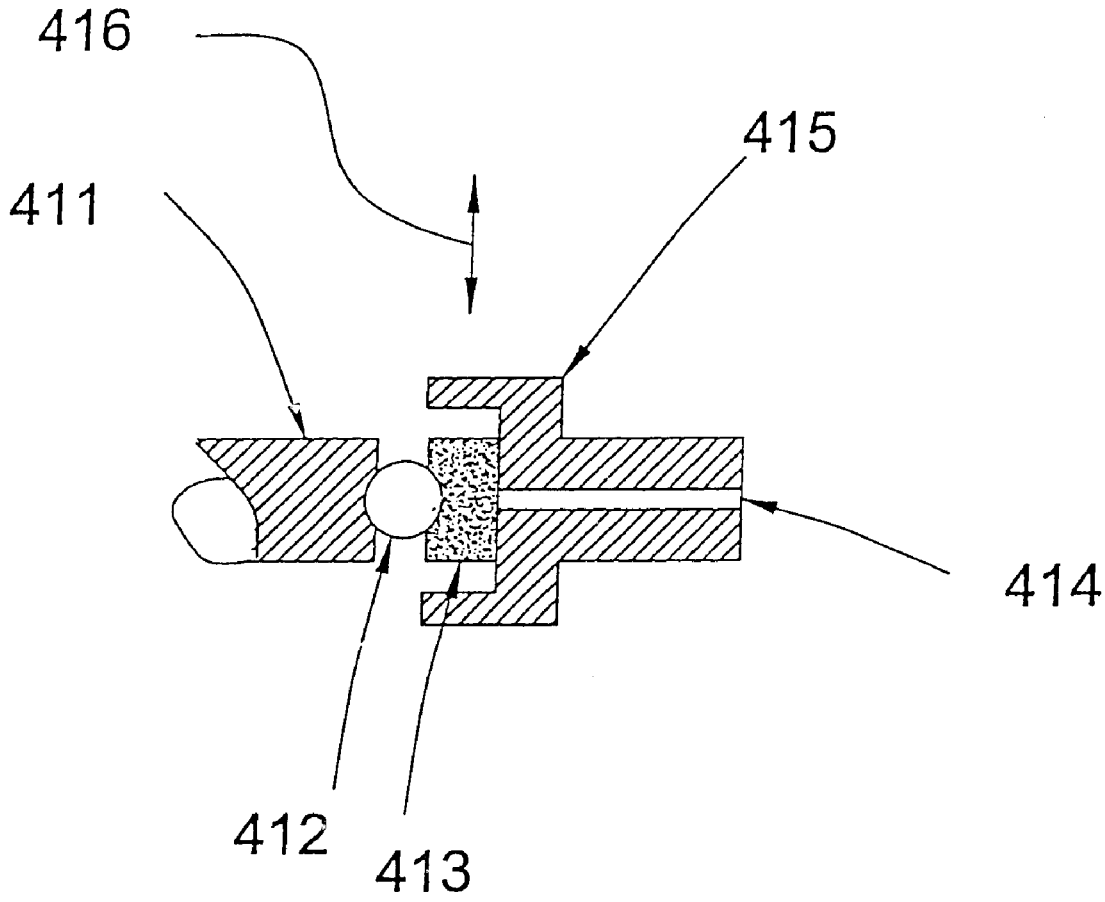
FIG. 11 is a cross sectional view of a non spring loaded radial floating cup.

FIG. 11 shows only the axial air bearing support 410 for a roller which allows automatic alignment of a shaft ball 412 and the bearing seat 413 during assembly of the roll system for manufacturing tolerances which cause minute variations of the ball center and the shaft axial centerline. The roll shaft 411 has a spherical ball attached integrally to its end or an equivalent roll shaft can be machined and ground to form a precision smooth spherical ball end on the shaft. An air bearing cup seat device 413 has a cylindrical shape with a flat bottom which loosely contacts a flat cylindrical surface machined into the end of a roll end support hub 415. This hub 415 has a high pressure air passageway 414 drilled from the outboard hub 415 end and extends through the hub to the contact surface at the interface between the bearing cup seat 413 and the hub 415. After all of the not-shown bearing components are assembled, the bearing seat 413 slides into position to automatically align itself with the ball 412. One method to attach the bearing seat 413 to the hub 415 is to apply non-cured polymeric composition (e.g., cement) to the outer peripheral edge only of the bearing seat 413 on the flat surface contacting the hub 414 prior to the assembly process. Then the unit is assembled, the components become aligned and the cement cures to hold the bearing seat 413 to the hub 415 sufficiently to resist the high pressure air fed to the base of the bearing seat 413. Later after the roll is installed in a machine, the cement could also be applied to the cylindrical outer periphery of the ball seat 413 to also contact the inside diameter of the receptor hole in the hub 415 so little, if any, cement is present on the flat contact surface between the bearing seat and the hub 415 which minimizes the blockage of air flow into the porous carbon or air orifice holes which is the air bearings functional essence of the air bearing cup seat.

Axial Air Bearing Piston

A separate air bearing is installed within the base or the hub and a short rod is inserted in this bearing. The air pressure is controlled in the cylinder pressure chamber to control the force applied by the cylinder piston against the ball which pushes axially on the roll shaft.

Figure 12:
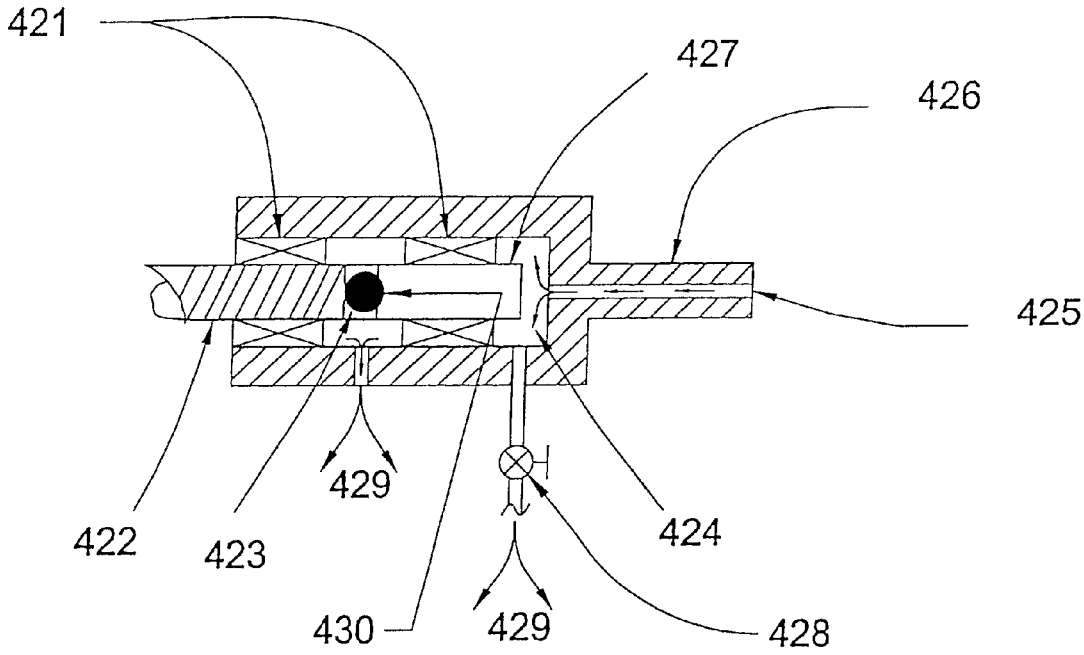
FIG. 12 is a cross sectional view of an axial air bearing piston.

FIG. 12 shows how an independent short piston rod 427 which either has a spherical ball end (not shown) or integrally contains a spherical ball 423 to form a sphere end. The ball 423 can be cemented onto the end of the cylinder piston 427 or it can be loosely captured within a socket (not shown) to prevent its radial motion relative to the end of the cylinder piston 427. The ball 423 then loosely contacts the smooth end of the roll shaft 422. In this way, the roll shaft 422 is allowed to travel radially over a small limited distance, which eliminates the requirement that the axial thrust force be concentrically aligned with the shaft axis. Not shown are air bearing up seat devices which can be integrated into the ball end of the cylinder piston 427. Radial air bearings 421 support both the roll shaft 422 and the cylinder piston 427. The cylinder piston 427 is preferred not to rotate, but it can serve much the same function if it does rotate. High pressure air 425 is inserted into the end of the hub 426 and enters a pressure chamber 424 which applies air pressure against the cross sectional area of the cylinder piston 427. Exhaust air 429 which originates from the air bearings 421 and exits through the hub 426 is released through valve 428.

Shaft Air Bearing Pistons

Figure 13:
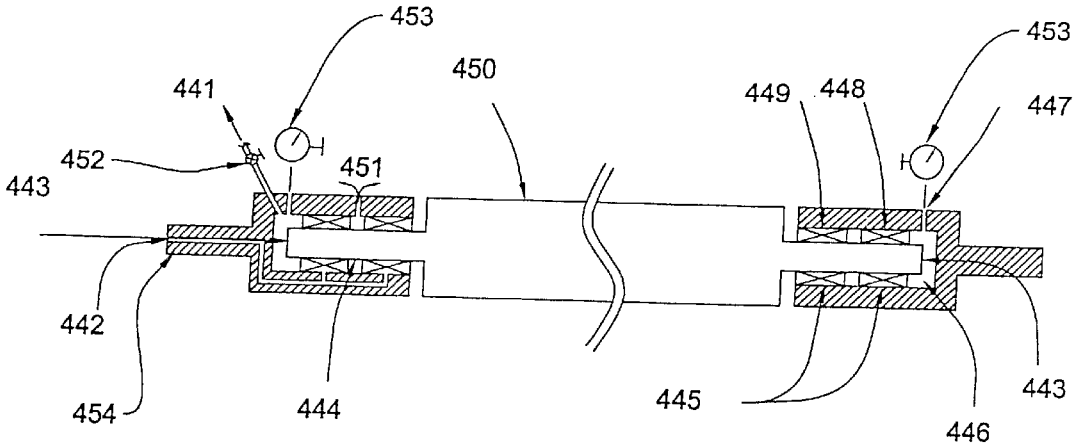
FIG. 13 is a cross sectional view of shaft air bearing pistons.

FIG. 13 shows a roller 450 with air pressure chambers 446 on both ends of the roll. The roll shaft 444 not only supports radial loads but also performs similar to a double acting air cylinder. The ends of the roll shafts 444 can be used as axial force pistons by adding another second air bearing 448 outboard of the first air bearing 449. The inboard first air bearing 449 provides most of the radial force support of the shaft. The outboard second air bearing 448 provides isolation of the exhaust air from the free end 443 of the shaft from the first air bearing 449. The exhaust bleed air 451 which exits the two air bearings 448 and 449 at the contact between the said bearing and the shaft 444 needs to be close to atmospheric pressure to provide the maximum shaft support pressure within the air film between the shaft 444 and the air bearings 448 and 449 inside diameter. A precision exhausting air pressure regulator 453 can supply air to and control the air pressure in each of the shaft end pressure chambers 446. The chamber pressure acts on the cross-sectional surface area of the shaft end to develop an axial force 443 equal to the pressure times the surface area when the pressure forces at both shaft ends are equal with the result that the idler roll 450 can be moved freely in an axial direction. A simple pressure relief valve 452 could be used on the pressure chamber 445 which would develop a back pressure of about 10 psi from the air bearing air source. Pressurized inlet air 442 is injected in a passageway drilled into the hub 454 to route air to the air bearings 445. An exhaust bleed air passage 451 is drilled into the shaft hub 454 to vent the air expelled from the air bearings 445 to the atmosphere.

Air Bearing with Shaft Chamber

Figure 14:
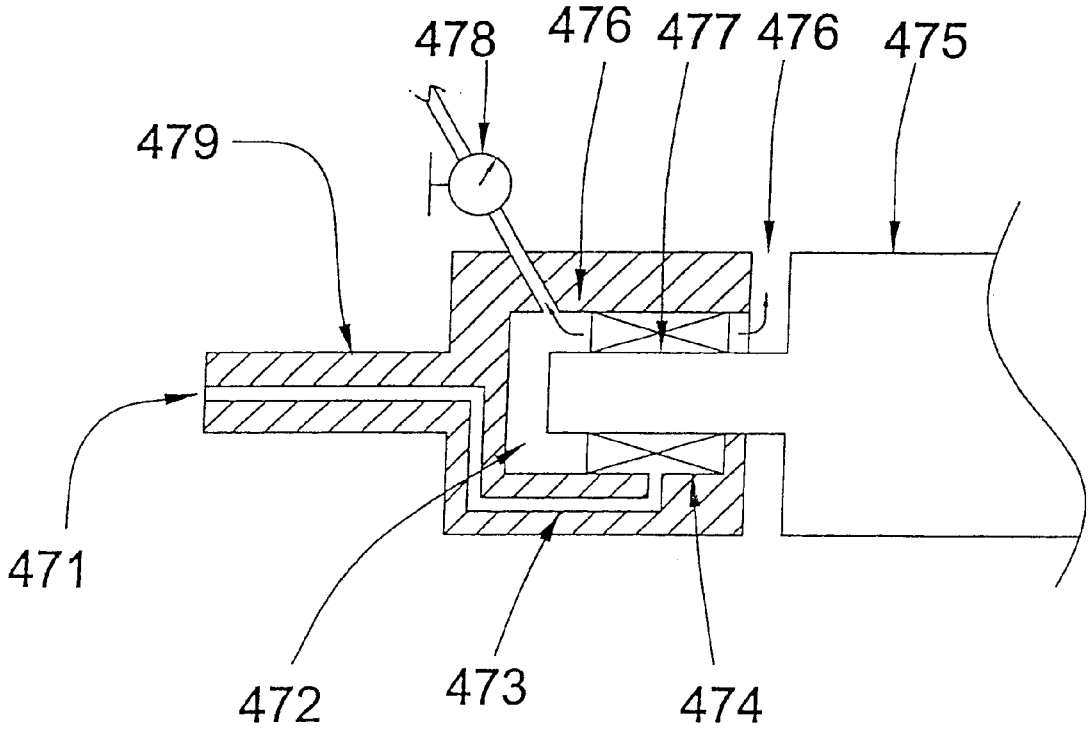
FIG. 14 is a cross sectional view of an air bearing with shaft chamber.

FIG. 14 shows a single air bearing 474 supporting a roller shaft 477 which is attached to a roller shell 475. The pressure regulator 478 controls the air pressure within the pressure chamber 472 located within the roll hub 479 at the outboard end of roll shaft 477. This pressure pushes on the cross sectional area of the roll shaft to produce an axial pressure on the roll. This type of axial bearing would be located on both ends of a roll assembly. An air tube passageway 473 would be created within the roll hub 479 to feed air to the outside radial portion of a porous air bearing 474. Inlet air vent 471 would be conveniently located in the outboard end of hub 479.

Note how the inlet air vent or tube 471 shares an approximately common axis A—A with the roller shell 475. This can enable an easier attachment of connecting air (fluid) sources, reduce eccentricity in the system and provide other benefits. This feature will be repeatedly shown though not necessarily specifically mentioned in numerous embodiments. The terms roll and roller are also used interchangeably herein without any distinction intended.

Shaft with One Axially Rigid End

Figure 15:
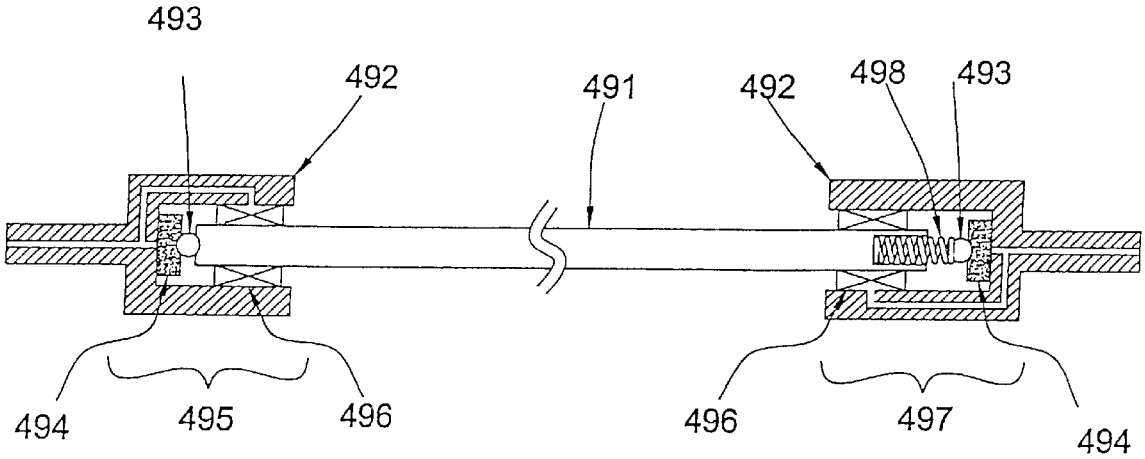
FIG. 15 is a cross sectional view of a shaft with one axially rigid end.

FIG. 15 shows a roller 490 with one end 499 solidly fixed in an axial direction but the other end 500 free to travel axially. Because on end of the shaft is held rigidly against its hub, and the other end pushes against the rigid end, there is compliance for thermal axial growth but no freedom for axial oscillation or vibration. A roller shaft 491 is held at both ends within the confines of roll hubs 492 by the use of radial load support air bearings 496 which are supplied high pressure air through the end of the roll hubs 492. The same air is supplied through the hub 492 to a porous carbon axial bearing seat 494 which is rigidly attached to the hub 492. A spherical ball 493 is attached to the end of the roller shaft 491 and it loosely is captured in the bearing seat 494. On the opposite end of the roller assembly, the ball 493 is supported by a compressed coil spring 498 which pushes the ball 493 into the bearing seat 494 and simultaneously drives this free end of the roll shaft 491 into the roll hub 492 at the opposite end. There is no axial slack in this roll assembly. The balls 493 associated with each end of the roll shaft 491 are separated from the porous bearing seats 494 by a film of air.

Belview Washer Spring

Figure 16:
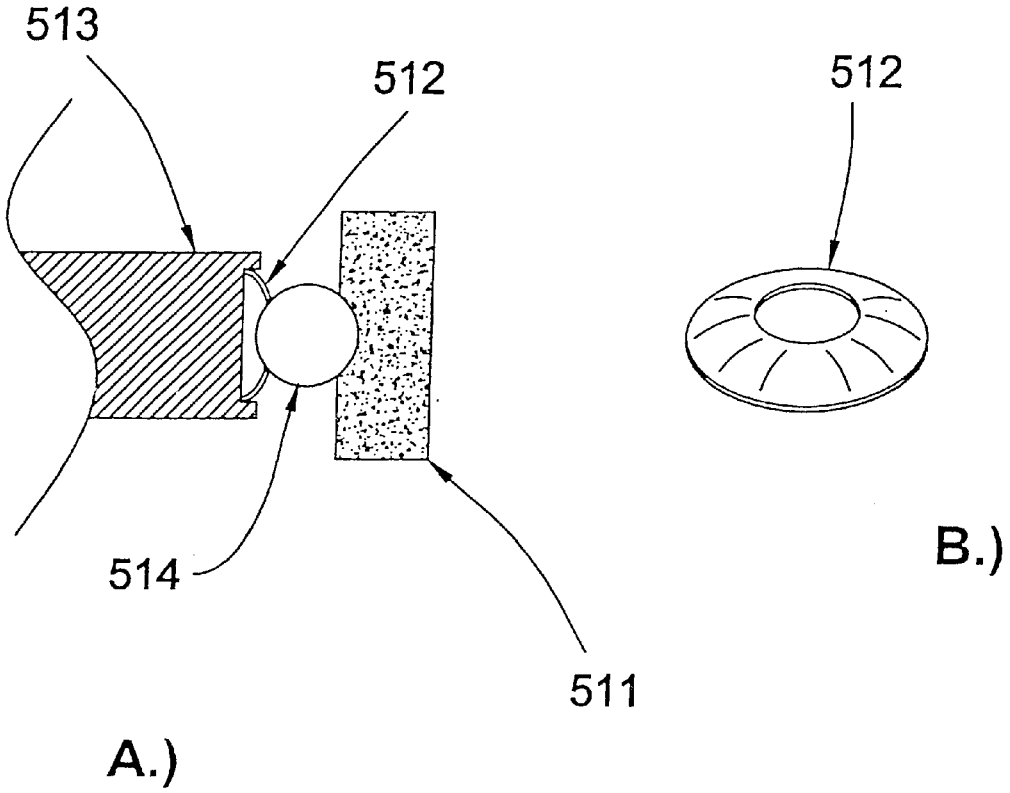
FIG. 16 is a cross sectional view of a Belview washer spring.

FIG. 16 shows a small washer shaped Belview washer 512 can be used as a spring to control the axial force on the shaft 513 and against the air bearing 511 by selecting the thickness of the steel washer and also by changing its diameter or by stacking these washers in series. The circular hole in the washer naturally will nest the ball 514 for a dependable inexpensive ball holding device with a very short axial length required.

Flat Air Bearing Shaft End

Figure 17:
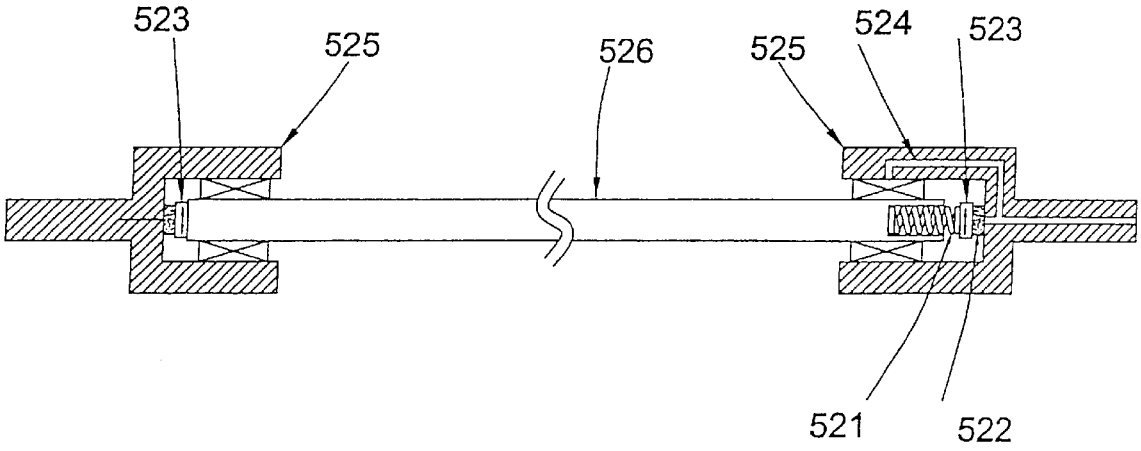
FIG. 17 is a cross sectional view of a flat air bearing shaft end.

In FIG. 17, the idler roll shaft 526 air bearing 520 supports the roll shaft 526 radially with a very small motion of the shaft radially by about 0.0005 and the disk 523 slides radially on the flat air bearing 522 by this amount, again on an air film.

Pivot Ball Disk End

Figure 18:
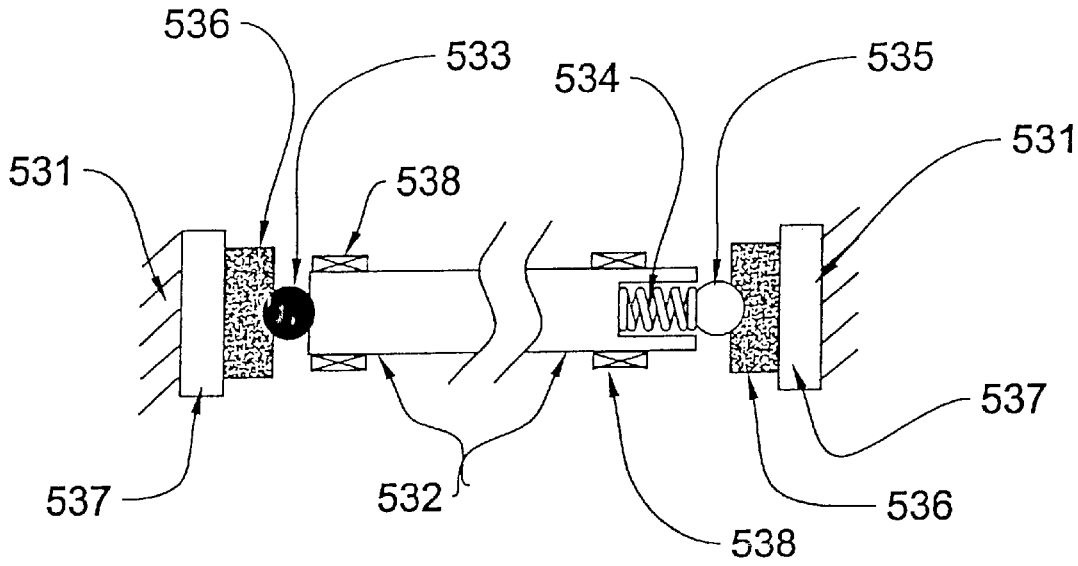
FIG. 18 is a cross sectional view of a pivot ball flat disk end.

FIG. 18, shows the pivot ball 533 imbedded into the disk 536 assures that the smooth hard flat disk travels parallel to the porous carbon air bearing 537 and also that there is no physical contact of the roll shaft assembly 532 with the carbon air bearing as a thin air film will separate the disk 536 and the carbon. A compression spring 534 is inset into one end of the shaft 532 to maintain an axial force on both ends of the shaft 532.

Ball Post Axial Restraint

Figure 19:
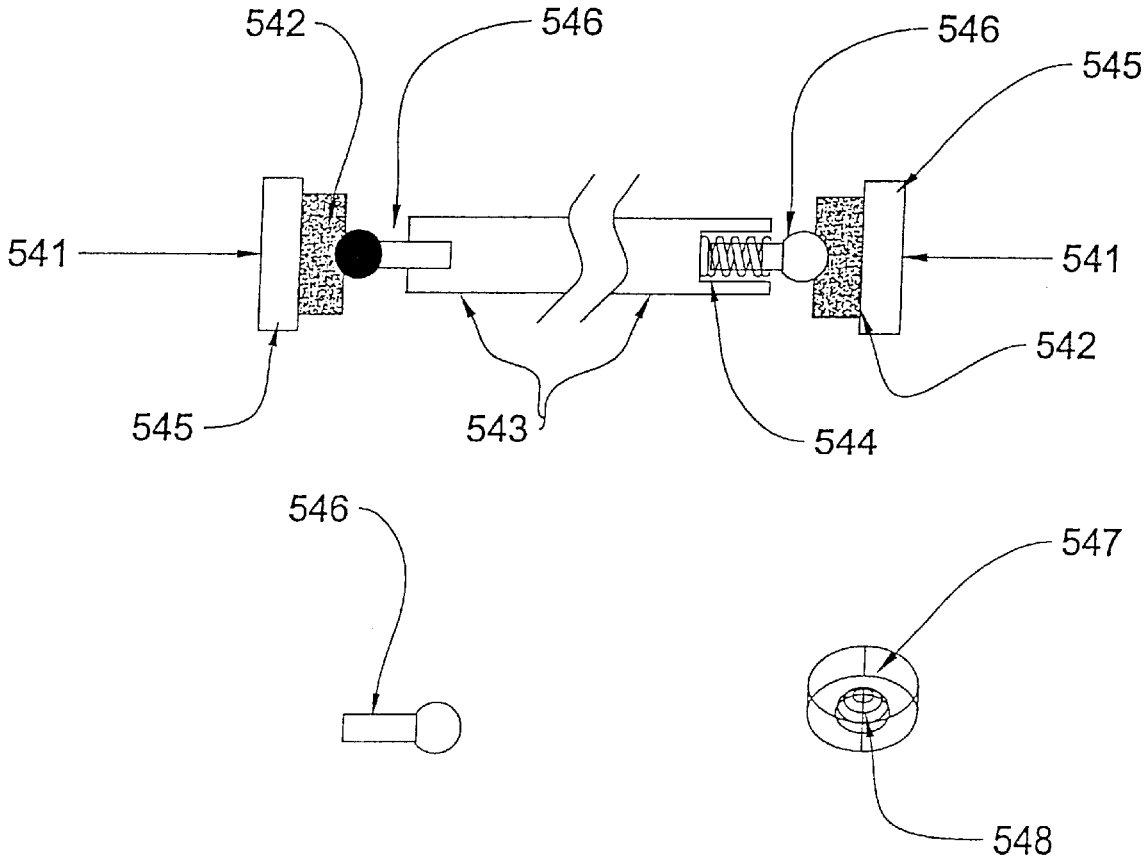
FIG. 19 is a cross sectional view of a ball post axial restraint.

In FIG. 19, the spherical pivot ball 546 can be a common unit where a ball 546 is an integral part of a post 546 which can be easily mounted into a roll shaft 543. This allows parallel alignment of the sliding disk 544 to the porous bearing 545 and yet retains the disk 542 in a fixed radial position relative to the roll shaft 543 end. Disk 542 has a generally cylindrical shape configuration 547 into which a spherical indent 548 is machined out.

Single End Axial Thrust Bearing

Figure 20:
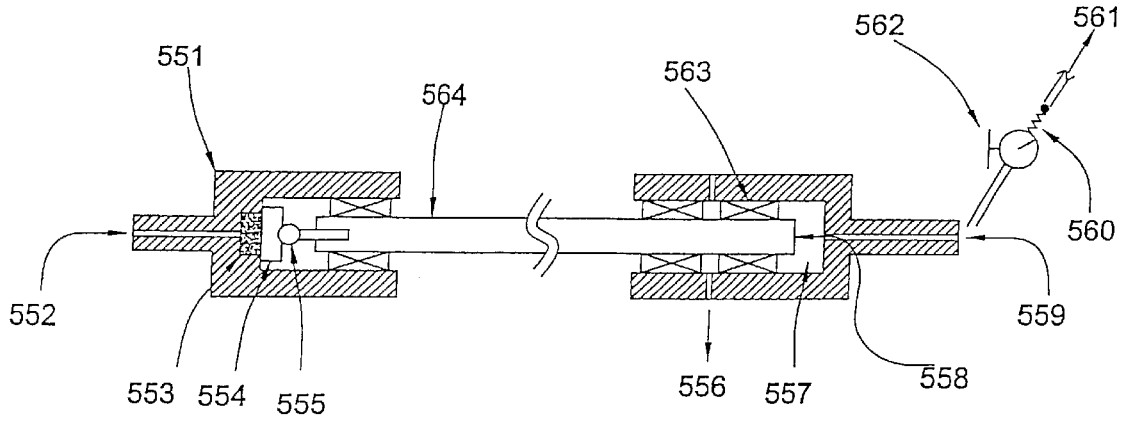
FIG. 20 is a cross sectional view of a single axial thrust bearing.

FIG. 20 shows an axial force applied to one end of a rotatable roll shaft 564 by air supplied by pressure regulator 562 having valve 561 and gauge 560. Air is supplied though passageway 559 to act against axial end 558 of the roll shaft 564. The roll shaft 564 abuts ball post 555 in spherical pocket 565 in disk 554 against porous carbon axial bearing 553 on support housing 551. Roll shaft 564 is supported by porous cylinder shell bearings 563 and air is exhausted between the two porous carbon bearings 563 from housing 551 by vent passageway 556.

Dual Ball Link Arms

Figure 21:
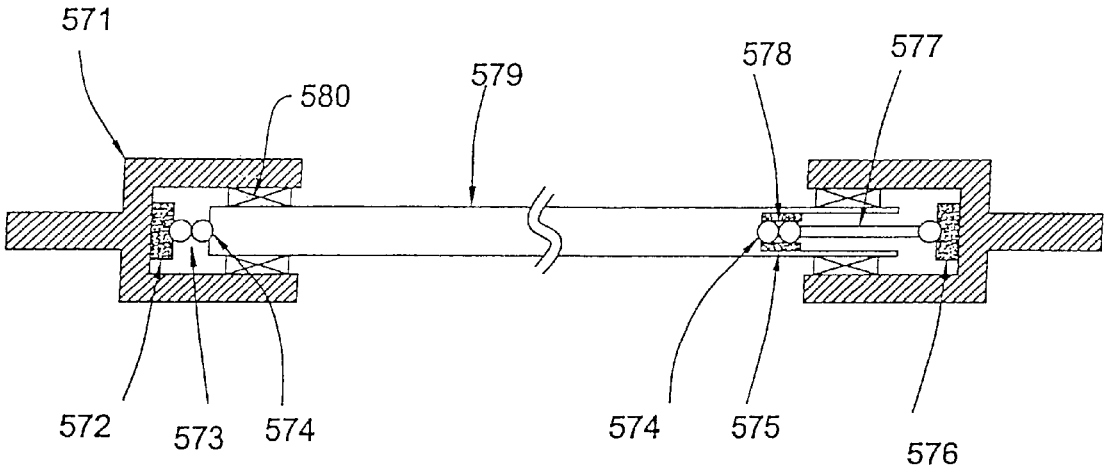
FIG. 21 is a cross sectional view of dual ball link arms.

FIG. 21 shows a system with dual spherical balls 573, 575 which allow low friction motion. Housings 571 have integrally mounted spherically indented air bearings 572, 576 which accept the dual spherical balls 573, 575 which are in contact with another spherical ball 574. The set of balls 575, 574 are in contact with a link arm 577. The shaft 579 is also shown.

Spring Loaded Linkage Arm

Figure 22:
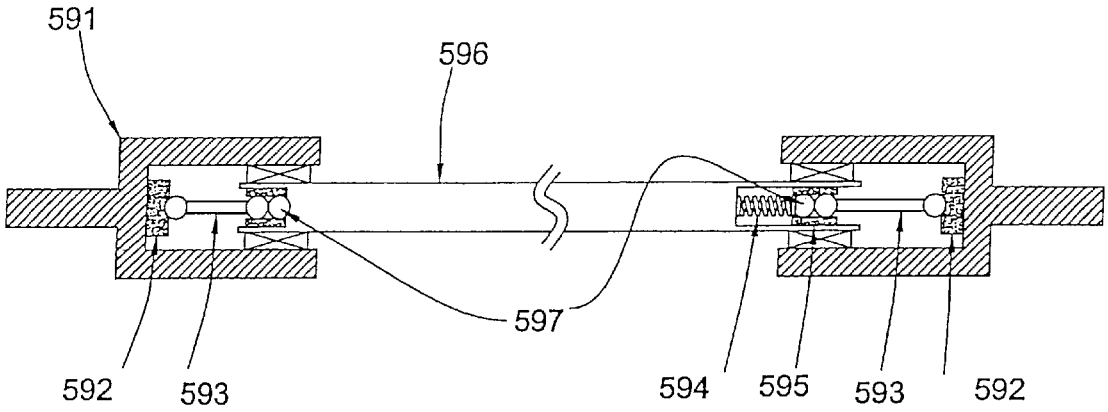
FIG. 22 is a cross sectional view of a spring loaded linkage arm without roll shell.
Figure 23:
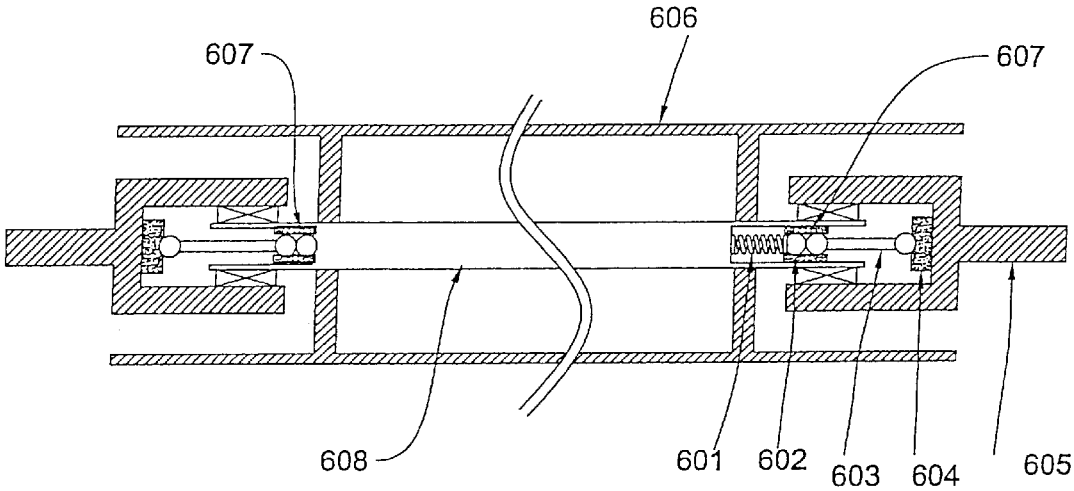
FIG. 23 is a cross sectional view of a spring loaded linkage arm with roll shell.

In FIG. 22, the two link arms 593 prevent axial motion of the roller shell 596 unless an axial force is applied to the roller shell 596 which exceeds the pre-compression of the ball compression spring 596.

Air Bearing Roll with Passive Axial Bearings

When an idler roll is supported by a radial air bearing, it is necessary to provide axial restraint of the roll to resist the relatively small axial forces applied to the roll surface by web contact or other sources. Various mechanical or air bearing systems can be employed to resist these axial thrust force loads. If the axial thrust bearing has a constant force load from either a spring load or an air pressure load to keep the roll shaft seated on one end of the roll, this constant force must be substantial enough to overcome the magnitude of the opposing web induced load. If the external web load is in the same direction as the axial spring load, the force on the axial air bearing is double the constant force. Either a constant force load or a double load will provide a force on the bearing which can potentially cause friction drag on the roll. There is thermal axial growth of the roll shaft and also contact abrasion wear of the axial thrust bearings.

When the air bearing roll employs axial thrust mechanical or different style air bearings fabricated so that a nominal 0.001" to 0.005" gap exists between the roll shaft end hardware and the bearing or bearing seat, then the rotating roll nominally will not have contact with either roll end and will not produce roll drag friction if the web does not induce axial forces. The thrust resisting capabilities of the axial bearing are only activated when an external axial force is imposed and the axial bearing support force is only equal to the applied force. Different styles of axial thrust bearings can be used on the same roll including spherical ball and spherical seats or flat disk shaft ends operating with parallel porous or air jet orifice bearings. Mechanical thread pins can be used to preset the bearing gap for the rolls.

Figure 24:
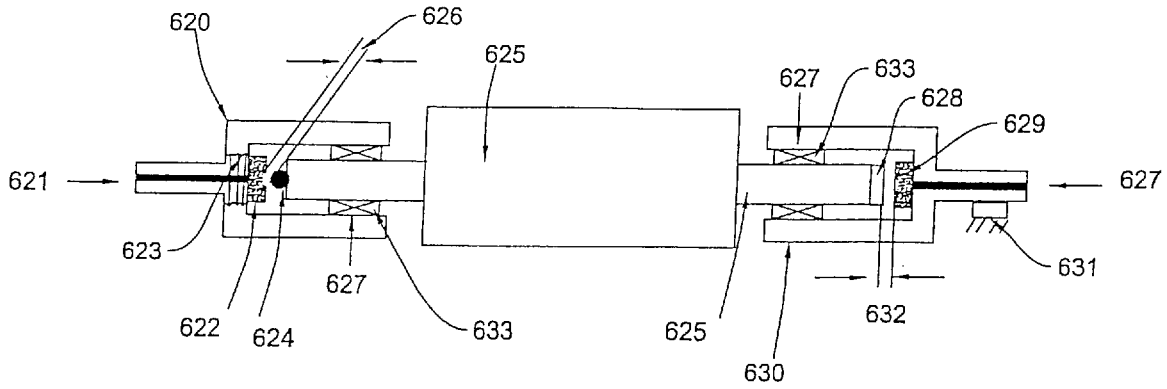
FIG. 24 is a cross sectional view of an air bearing roll with passive air.

FIG. 24 shows a roll 635 with passive axial thrust bearings 629 where the roll shell 625 is captured between two roll hubs 630 and the roll 635 either has air bearing film separation support on one end of the roll 635 or the other opposite end of the roll 635 as a nominal air gap 632 is set between the stationary and moving parts of the roll assembly 635. The opposite end of the roller 625 shows the same basic deliberate gap setup but a spherical seat 626 is mounted on a threaded hub screw end 623 which can be axially adjusted by use of matching threads in the roller end support hub 620. An air inlet 621 supplies air to the ball seat thrust bearing 622. The roll shaft 625 has a spherical ball attached to it and a gap 632 exists between the ball end and the ball seat 626. The roll hub 620 is held to a machine frame by a roll end clamp mount 631. Radial support is provided to the roll shaft 625 by a porous air bearing 633.

Figure 25:
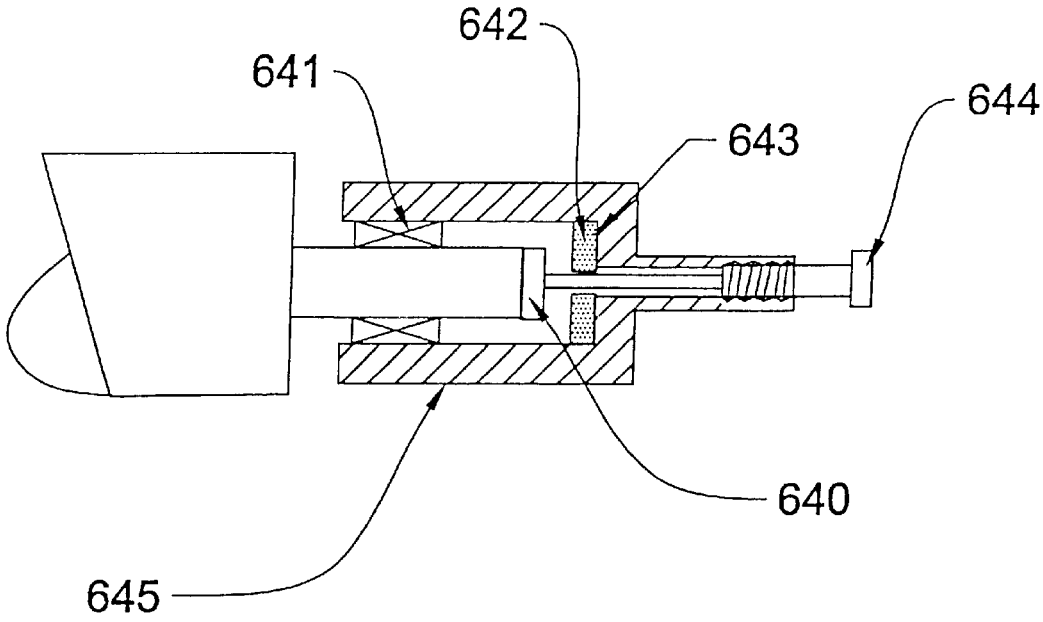
FIG. 25 is a cross sectional view of an air bearing roll with passive adjustable shaft gap.

FIG. 25 shows the cross sectional view of a roll end with an adjustable axial mechanical screw mandrel 644 which is threaded into the axial length of a roll support hub 645. The axial mandrel 644 passes through the center of a cylindrical shaped flat air bearing 642 which is fed high pressure air from discrete air inlet holes 643 drilled into the hub 645 body. High pressure air is also routed through an inlet hole 641 drilled into the hub to supply air to the radial shaft support air bearing. A preformed flat disk 640 is attached by cement to the end of the roll shaft. As shown, the end of the adjustment mandrel 644 contacts the disk 640 to push the disk 640 and integral shaft end away from the facing air bearing 642 surface by a set amount of perhaps 0.005 inch to establish a gap between the rotating shaft disk 640 and the stationary axial thrust air bearing 642.

Roller Axial Adjustable Bearing

The amount of gap that is desired between a roller axial thrust bearing and the roll shaft end is set differently for each size of roll, its thermal stability and the ease of set-up. Further, these bearings will experience some wear which requires resetting the gap and also it may be desirable to either replace bearings or change to a different design or different material bearing. This adjustment feature or the interchangeability of bearings is desirable in a roll. Further the operating characteristics such as fluid bearing stability is important. Because of the air source, corrosion is always an issue as is dirty air.

A roller may be constructed with the air active portion of the bearing half contained in a precision ground mandrel which is threaded on one end to adjust the gap between the two bearing halves. The nose of this handle closest to the bearing would be centered within a matching precision hole which is near-perfect in concentricity with a matching spherical ball integral to the roll shaft end. This sphere ball seat set will allow the axis of the roll shaft and the hub mounted bearing cup to be angled to each other and still function very well because the ball end of the roll shaft will nest accurately in the bearing cup end contained in the roll end mounting hub. However, with this spherical cup bearing design, it is critical that the center of the ball seat bearing be exactly concentric with the center of the roll shaft ball end to allow the ball to fit into the ball seat with near surface to surface contact where the air bearing film of air is created which keeps the two bearing component parts physically separated for low friction. The radial roll shaft air bearings would also be mounted with precise concentricity so their center line coincides with the center of the spherical ball bearing. When a porous carbon air spherical bearing is used, it is expected that the somewhat soft and fragile carbon will be worn away at the high spot contact areas between the cup seat and the mating ball. This wear will increase the gap between the end of the shaft and the cup and can simply be adjusted out by threading in the bearing holder mandrel to obtain an improved alignment matching of the ball and cup seat, the wear in rate may be enhanced by removing a small amount of carbon material at the center of the graphite cut so that the ball contacts the cup seat at the outer 75 percent of the surface area at the periphery of the cup seat. Enough thickness of the porous carbon is left at the center 25 percent area which is recessed by perhaps 0.005" to 0.010" from the original curved surface so that air is still effectively metered out in this center section much the same as it is in the outboard contact section. As the air flows quite uniformly over the surface of this carbon bearing, which is nominally about 0.125 to 0.150" thick, there will not be the tendency to have air bearing vibration type of instabilities with air surging out of the film gap between the bearing members. The wear-in fitting will take place faster at the outside diameter of the ball seat as the surface speed increases with the further distance from the axis of the roll shaft thus the center will have little wear. In the event that a bearing is damaged, a new bearing can be installed, run-in with the roll shaft being operated in contact with the bearing seat to remove the high areas, and the gap set to the desired amount.

The same technique can be employed with air jet orifice bearings where perhaps three orifice jet holes are located within the cupped bearing seat. High pressure air is metered from these holes and develops a film of air between the seat and the ball end of the roller shaft. One version of this is to simply create a spherical ball seat in metal or plastic with a ball nosed milling cutter and drill out small holes and insert jeweled precision orifices in each of the holes to meter out even flow of air through each of the individual holes. This air is loosely trapped between the surface of the ball and the ball seat to create an air film which physically separates the two components. Other techniques can be employed to give better "lift" or separation of the two bearing components for initial operation by increasing the contact surface area to be much greater than the orifice hole entry and also to improve the dynamic fluid stability of the ball bearing set. This can be done by etching small land area paths which extend circumferentially from each hole in short paths in both directions but short enough that a path from one hole does not intersect with a path from an adjacent hole. Each path may be 0.010 to 0.015" wide and perhaps 0.001 to 0.005" deep. Another technique is to rough out a spherical seat, drill the orifice holes and then excessively coat the spherical cup seat with a low friction and low coefficient of thermal expansion epoxy-like cement and then insert a perfectly smooth and round ball into the pocket seat. After curing, a low friction cup seat is created which perfectly matches the sphericity of the matching spherical ball.

In a like fashion, most of these same techniques can be employed to create a flat contact round air bearing axial support system for roller support. The radial motion of the roller shaft due to wear or tolerances of the inside diameter of the air bearing or tolerances of the outside diameter of the roll shaft are not so important. When using a flat matching air bearing of either a porous carbon construction or a set of discrete orifice holes, it is critical that the axis of the roll shaft be precisely perpendicular to the matching flat surface of the air bearing attached to the roll shaft hub mandrel. To create this smooth flat perpendicular surface on the roller shaft, it can be machined or ground or a polished flat disk can be attached to the end of the roll shaft. Again, all the special features described for the spherical bearing can be utilized for the flat bearing including gap adjustment, wear in of the bearing set to produce an accurate match of the bearing components, the removal of the bearing center material so contact is primarily at the high surface speed area of the bearing sliding surface and the etch relieved air orifice holes.

Corrosion is always an issue with air bearing systems so it is desirable to utilize non corrosion construction materials such as aluminum, stainless steel, brass, plated metal, plastics, glass, jeweled components and to use dry air or other gas sources such as nitrogen which is filtered to less than 1 micron to avoid plugging of the porous carbon or the orifice jets.

Figure 26:
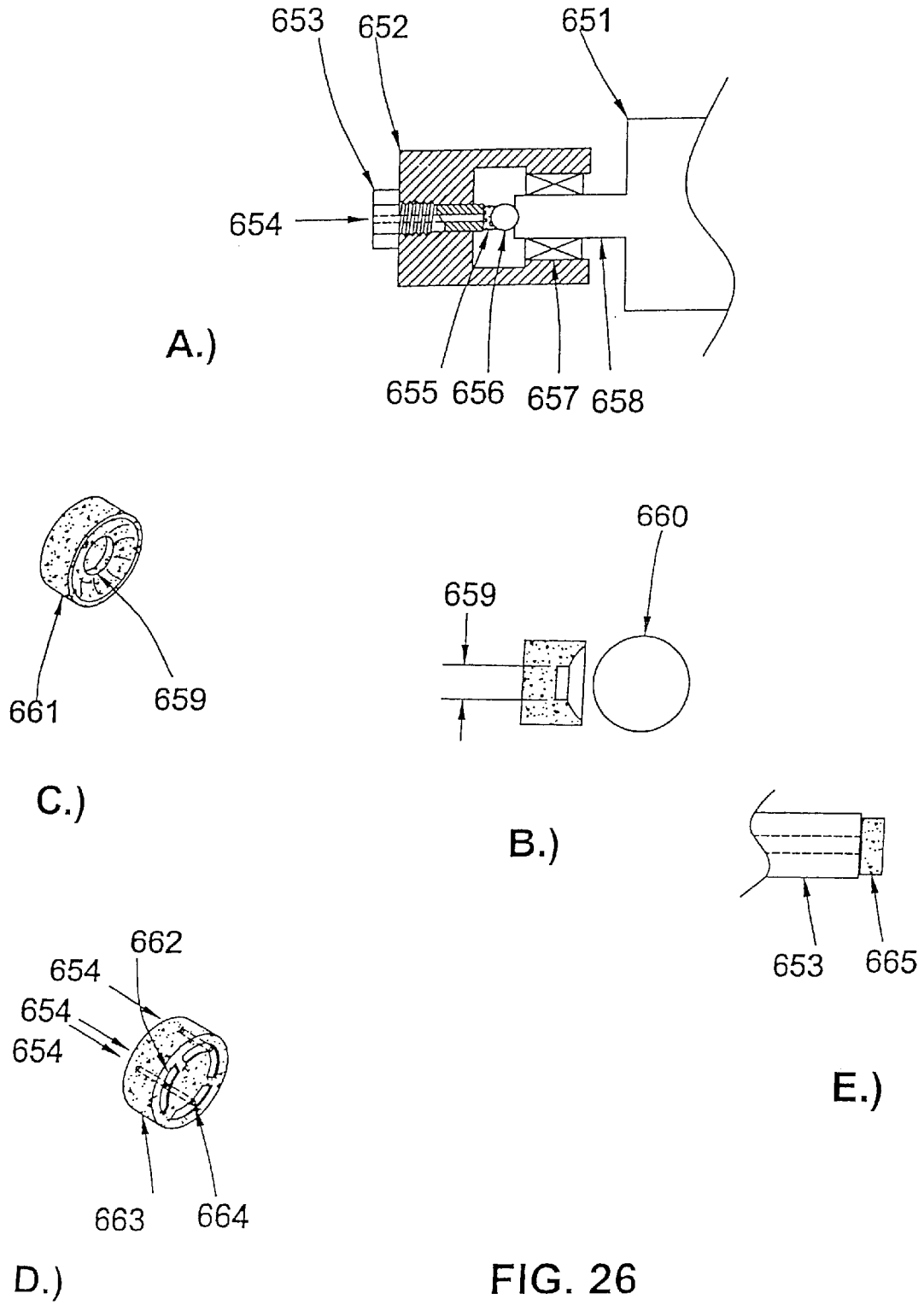
FIG. 26 is a cross sectional view of a roller axial adjustable bearing.

FIGS. 26*a*.), *b*.), *c*.), *d*.) and *e*.) show different views of component items that can be used individually or collectively together to construct an air bearing roll assembly.

FIG. 26*a*.) shows a roll shell 651 which is integrally attached to a roll shaft 658 that is radially supported by a porous carbon air bearing 657. The end of the roll shaft 658 has a ground spherical shape or has a discrete spherical ball 656 attached to it. This ball 656 is nested into a cup shaped porous carbon air bearing seat 655 which is attached to the end of a threaded screw mandrel 653 which has a pressurized air inlet 654 hole drilled on its centerline to feed air to the cup seat air bearing 655. The threaded screw mandrel 653 can be advanced or retarded by use of matching threads in a roll end support hub 652 which has a precision cylindrical hole to support a matching cylindrical end of the mandrel 653. The matching cylindrical forms radial support of the mandrel 653 while a formed nut shape on the mandrel 653 allows it to be advanced and locked (not shown) to precisely set the desired air film gap between the spherical ball seat 655 and the shaft ball 656.

FIG. 26*b*.) shows a porous carbon spherical ball seat 655 as referenced in FIG. 26*a*.) which has a matching ball 660 with a recessed area 659 cut out of the ball seat 655 to better allow wear-in of the ball 660 into the ball seat 655.

FIG. 26*c*.) shows another view of the ball seat 661 with a cylindrical shaped recessed area 659.

FIG. 26*d*.) shows another style of ball seat 663 which is made of solid metal on solid plastic or low friction surface coated metal. An air film is generated between the ball 660 and the ball seat 663 by injecting pressurized air into three (shown here) drilled air passage holes 664 which intersect three shallow and narrow tangential path segments 662. Air from each independent hole 664 enters into the recessed path areas 662 which provides a larger ball 660 support area than the cross sectional area of an independent drilled orifice hole 664 to obtain better liftoff of the ball 660 from the ball seat 661 when air pressure is first applied to the system. Each of the recessed paths 662 do not intersect tangentially with an adjacent path so air does not leak from one path to another and a true three-corner support is provided to a ball 660 which prevents loss of local air support pressure at one segment of the contact area if a ball is driven off-center by forces applied to a ball shaft 658. The recessed air path segments may be 0.005 inch to 0.050 inches wide, 0.001 to 0.005 inches deep and would have a tangential arc length of 100 degrees if three paths were used.

FIG. 26*e*.) shows how a flat pre-ground air bearing disk 665 of the desired material, flatness and surface finish can be attached to the end of the mandrel 653 to form a flat air bearing axial support joint in place of the spherical ball joint already described with the use of the ball seat 655 and the ball 660.

Roll with Annular Air Bearing

Alignment of an air bearing roll when mounting it to a machine frame is critical to prevent jamming of the cylindrical shaft supporting air bearings which will increase rolling friction. Also providing enough surface area of the axial thrust support air bearings is crucial to prevent physical contact of the bearing elements. Limiting the exposure of the fragile porous carbon air bearing elements reduces the possibility of damage to them from maintenance functions and also from debris when operated in a harsh environment.

One solution is to construct an air bearing roll with an annular axial bearing which surrounds the roll live shaft and which runs in near-contact with an annular portion of the end of the roll which has been precisely ground flat. The high pressure air supplied to an air bearing mounted on the roll hub acts over this very uniform gap thickness and develops a pressurized air film between the roll end and the bearing surface. The same source of high pressure air or other gas would be fed into the roll hub end and would be routed within the hub to both the radial support shaft bearing and also to the axial shaft support annular disk bearing. The annular disk bearing could have the configuration of a single continuous annular ring of porous carbon or it could be constructed in separate segments which are placed in a circular pattern to contact the annular ground surface of the roll end. A pillow block mount can be constructed with a clamp which would tighten a "split half-moon pair" of spherical collar set which would be mounted in a spherical seat receptor to attach the roll assembly to a machine frame. This loose split collar set would allow the roll assembly to freely self-align without binding the very close fitting air bearing elements with the roll shaft before tightening. Also, a loose fitting shell retainer ring can be used to prevent the roll hub ends from sliding off the roll shaft prior to final installation. This retainer ring would also protect the fragile air bearings, which can be easily chipped by contact with sharp objects, by keeping the hub end close to the body of the roll shell. Air inlet passages can be drilled into the end of the hub, where it protrudes beyond the roll hub mount, so that air can be conveniently routed to and connected to the roll assembly as it is installed on a machine frame. Drilling holes in specific and discrete locations to route the high pressure inlet air to both the axial and radial air bearings from a single air inlet on both ends of the roll. In this way air can be supplied to the whole annular air bearing surface by joining a drilled air line in the hub body with a cylindrical groove cut into the face of the hub under the mounting surface of an annular porous carbon air bearing element. Air which exhausts from the axial and the radial air bearings can be conveniently exhausted from the internal section of the air bearing hub assembly by drilling air exhaust vent holes radially through the hub body in a sector so they do not intersect with the high pressure air passageways. If the air is not freely exhausted from the air bearings, the air pressure downstream of the air bearings will build up and eliminate the flow of air through the bearing and also eliminate the pressure head which supports the external force loads on the bearing. If this happens, the bearing becomes totally or partially ineffective. Both, or either, the porous carbon air bearings used for the axial bearing and the radial bearing could be replaced with orifice jet bearings if desired.

Figure 27:
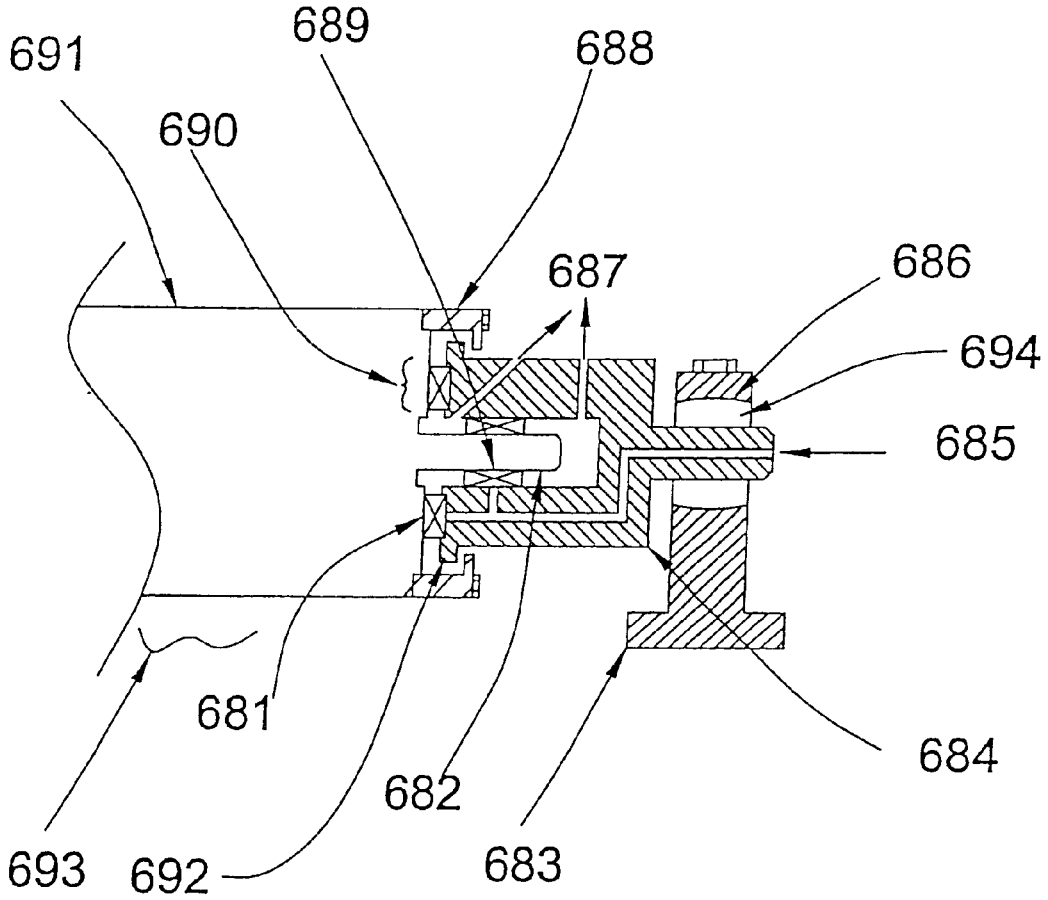
FIG. 27 is a cross sectional view of a roll with annular air bearing.

FIG. 27 shows a cross sectional view of one end of a roll which has a number of special features such as a rigid annular axial thrust air bearing surrounding a roll shaft and also a spherical seat roll end pillow block mount. The roll shell 691 has an integral roll shaft 682 which is radially supported by a porous carbon air bearing 689 which has a pressurized air inlet 685 into an air passage within a roll hub 684. This air inlet 685 also feeds an annular axial thrust porous carbon air bearing 681 which is mounted to a roll hub 684 in such a way that the pressurized air fed in at its base mounted in the hub 684 passes through the axial thickness of the bearing and exits at the bearing 681 surface adjacent to the roll shell 691 end. The nature of pressurized airflow through the thickness of the porous carbon bearing 681 material is to act as a combination air diffuser and air restrictor which results in the air flowing out the front surface at a flow rate very uniform across the whole exposed surface. The axial bearing 681 is mounted within the end of the roll hub 684 with the use of adhesive cement so as to structurally attach to the hub 684 to resist the pressurized inlet air 685. Also, this bearing 681 has its outside peripheral edge of its cylindrical shape seal with this same cement so that all of the inlet air 685 passes axially through the bearing toward its free surface facing a roll shell 691 and annular land area 690. Pressurized air is directed around the circumferences of the air bearing 681 by machining an air passageway groove (not shown) in the end of the hub 684 at a location centered on the annular radius of the bearing 681. The air which is exhausted uniformly on the surface of the bearing 681 pushes against the annular land area 690 and prevents physical contact between the bearing 681 and the land area 690. To reduce the possibility of damage to either the bearing 681 and the land area 690, the land area 690 is ground and polished to be precisely perpendicular to the roll axis within 0.0001 inch across the width of the land area 690 and smooth within 2 to 5 micro inch RMS. The land area 690 is formed in the shape of an annular plateau by relieving or removing material both toward the inside radius adjacent to the roll shaft 682 and also on the outside radius toward the roll shell 691. Pressurized air that enters radial bearing 689 and axial bearing 681 both require exhaust air passages 687 that are created by drilling two holes radially through the wall of the shaft hub 684 to allow free passage of this spent air to the atmosphere. The exhaust air holes 687 are located radially within the hub 684 so as to avoid intersection with the other holes drilled in the hub 684 to supply pressurized inlet air 685 which prevents leakage of the pressurized air into the exhaust air chambers. One exhaust chamber exists at the free end of roll shaft 682 and the other chamber exists at the base of shaft 682 with walls formed by the side edges of both the radial air bearing 689 and axial air bearing 681. With this configuration, the roll shell 691 is restrained radially by air bearing 689 and is restrained axially by air bearing 681. The flat contact surfaces of the axial air bearing allows minute radial motion of the roll shell 691 without creating any new frictional physical contact during this radial motion action. A removable retainer ring 688 is attached to the end of the roll shell 691 at the outer radial edge to loosely contain a raised annular ledge 692 on the roll shell 691 end of the roll hub 684. The only function of this retainer ring 688 is to prevent the roll hub 684 from slipping more than a short distance of perhaps 0.050 to 0.10 inch axially toward the free end of the roll shaft 682. Excessive axial slippage could cause the free end of the roll shaft 684 to contact the fragile inside diameter surface of the radial air bearing 689. During the roll installation procedure of mounting the roll shell 691, the roll hub 684 and the roll end mount 683 to a machine base, the roll hubs 684 are positioned so no contact can be made between the roll hub 684 raised annular ledge 692 before tightening the spherical roll clamp 686 which locks the hub 684 to the roll end mount 683. To assure that the roll assembly 693 is installed and alignment trammed to a machine base without introducing misalignment forces on the air bearings 689 and 681, a special spherical pillow block type clamp 686 device is created. Here a spherical collar with a cylindrical inside diameter and a spherical shaped outside diameter is nested within a two part clamp mount with a bolted on top housing. The spherical collar is cut in half with the cut line parallel to the inside cylindrical axis which forms top and bottom moon shaped halves 694 of the spherical collar. When the bolted on top is loose with the roll hub 684 installed as surrounded with the split spherical collars 694. This spherical clamp assembly is similar in construction to a standard pillow block shaft mount except a spherical motion of the clamp has been added. Because the split collar pieces 694 are cut in half, they will not completely surround the roll hub 684 as the thickness of the saw cut blade is removed from the common end joint which results in effective clamping of the shaft when the top half of the spherical roll clamp 686 is bolted together. This roll clamp 686 allows a roll assembly 693 to be mounted with each of the two roll clamps 686 to be mounted at different elevations and at an angle to each other as required for web steering tramming alignment with the roll assembly to be in a mutual state of natural alignment of all components that is completely free of residual friction causing binding of the moving roll shell 691 and its shaft 682.

Figure 28:
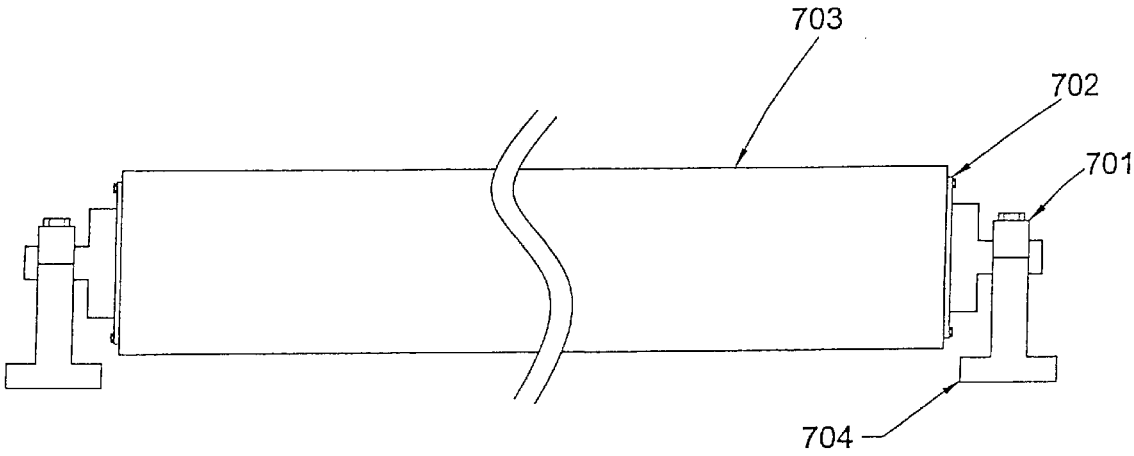
FIG. 28 is a cross sectional view of an air bearing roll assembly.

FIG. 28 is a view of a complete roll assembly 704 which has a roll external shell 703, a retainer ring 702 and a spherical pillow block roll hub mount 701.

Grinding of Roll Thrust Bearings

It is critical that the moving rotational and the stationary hub elements of an axial thrust air bearing precisely match the shape of each other at the interface gap where an air film separates the two parts physically. Cumulative manufacturing tolerances and misalignments during assembly and operational "wear-out" are initial and maintenance issues. Old bearing elements need periodic maintenance with part replacement.

An air bearing roll is fabricated and assembled to best practice manufacturing processes which establishes the fit characteristics of each component part relative to all of the other parts in the assembly. Then the assembly is partially disassembled and abrasive material is applied to the air film gap between the moving and stationary bearing elements. This abrasive can be dry particles of aluminum oxide, diamond, cubic boron nitride (or others) or it can be wetted with water or other chemicals to form a slurry. Also a circular or annular disk of 3M diamond coated abrasive or Trizact can be cut out to fit the geometry of one element of the air bearing and be temporarily attached to it with PSA adhesive. Then the roll would be reassembled and the roll shell rotated from 10 to 5,000 RPM with a slight axial force of 0.1 to 10 lbs. applied to the roll shell to hold it against the stationary hub mounted bearing and this process repeated for the bearing on the opposite end of the roll. After the bearing set is ground to fit satisfactorily, the roll is disassembled, the abrasive removed, the parts cleaned and the roll reassembled with a typical gap uniform to a desired 0.0001 to 0.0005 inch thickness. New rolls can be manufactured with this process and old rolls can be re-ground in the field easily and effectively. Sheet coated abrasive can be used for flat circular or annular thrust bearings and loose abrasive can be used for spherical cup or cone cup shaped bearings. When loose abrasive is used, both the moving and stationary elements are ground or lapped. PSA sheet abrasive can be installed to grind one bearing element and then reversed to grind the other element face. 3M brand abrasive sheets are flat within 0.0001 inch, good for this use.

Figure 29:
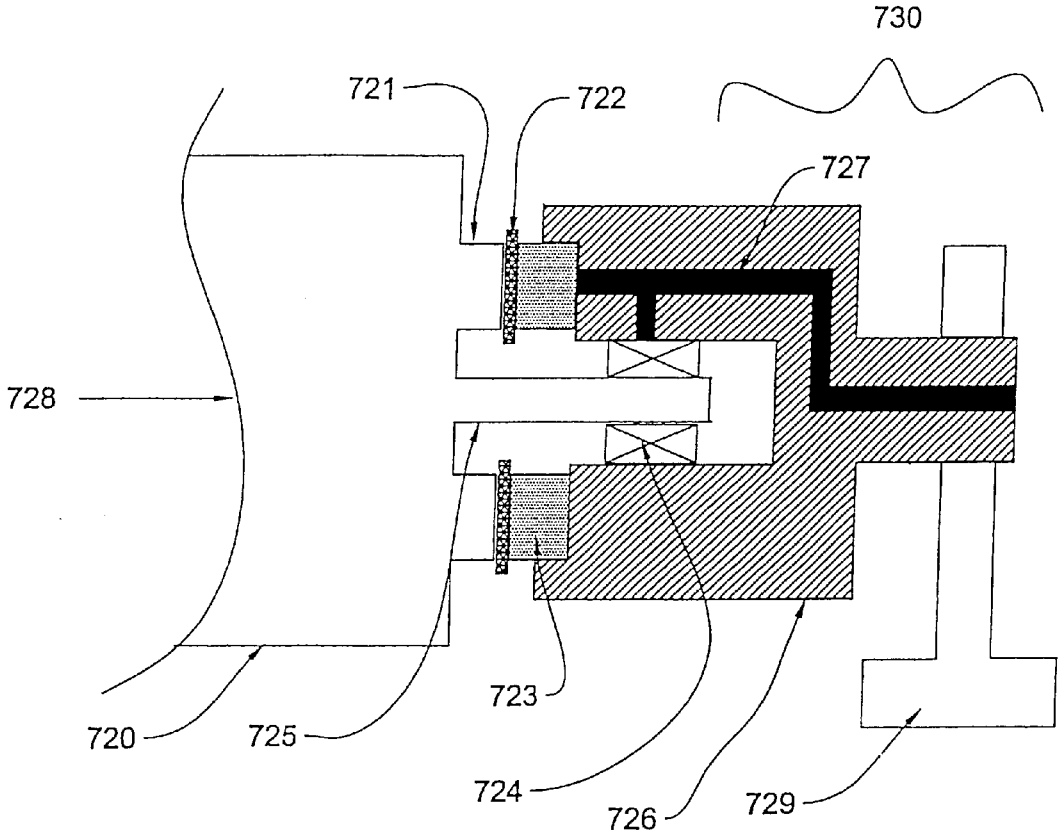
FIG. 29 is a cross sectional view of grinding of roll thrust bearing.
Figure 30:
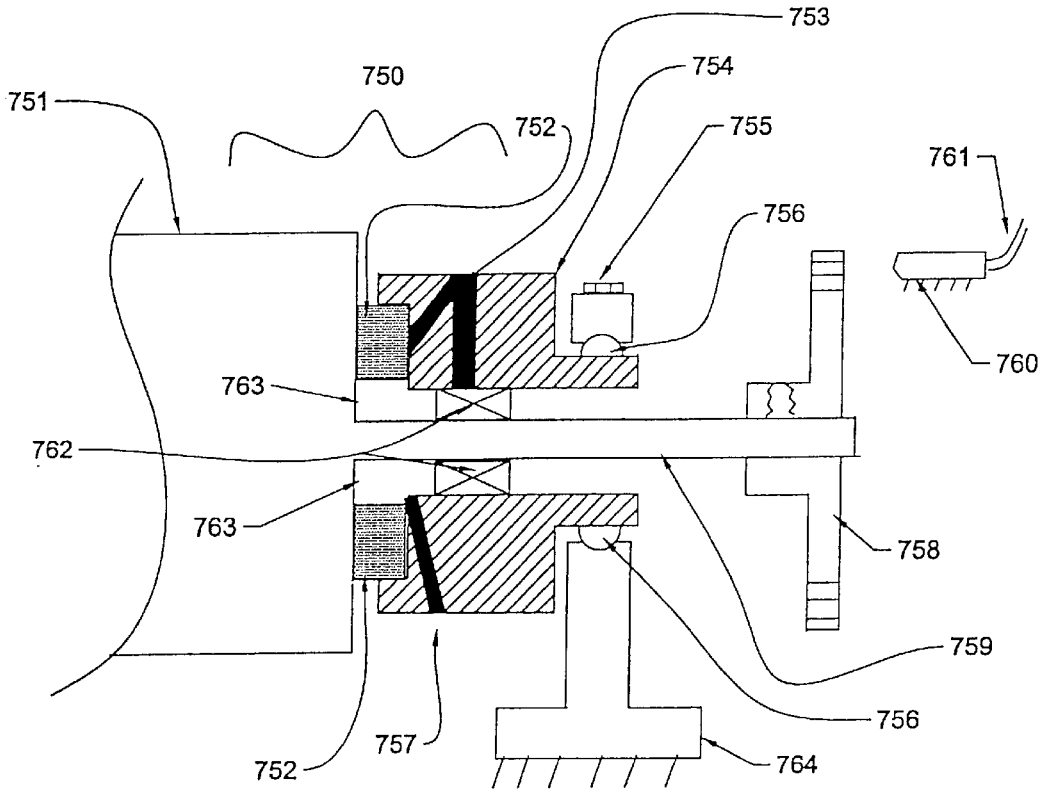
FIG. 30 is a cross sectional view of an exposed shaft air bearing roller.

FIG. 29 shows a cross sectional view of one end only of an air bearing roll. The opposite end of the roll may be a duplicate of this shown end or it may also be one with spring loaded air thrust bearings or air bearing thrust cylinder bearings. A variety of combinations of different types of roll thrust bearings may be used on a single air bearing roll assembly. The technique of match grinding of the air bearing set is described with this specific rigid mount configuration as an example but it is expected that this process is used on air bearings which have one element of the air bearing mounted on a compliant spring. The grinding or lapping process may be applied to other thrust air bearing set configurations. Generally, a primitive surface which is flat or spherical or cone shaped is precisely manufactured and the grinding or lapping process is started. At completion, the precision of the fundamental primitive shape may be somewhat altered but the fit between these parts will tend to allow them to precisely nest together. All the ground portions of each surface will match the other surface within 0.0001 inch which is very adequate for an air bearing support film of pressurized air.

In FIG. 29, a roll shell 720 with an integral roll shaft 725 fits into a radial load air bearing 724 which is mounted within a roll end support hub 726. An axial thrust air annular bearing 723 can be constructed of porous carbon. Not shown here would be an alternative thrust air support bearing which employs air orifice holes which can be fabricated as a device with small holes drilled through the thickness of the annular ring to direct high pressure air from the back hub 726 surface to the front surface facing the roll 720 body. Small orifice jets would be used in each of the drilled holes to assure constant uniform airflow through each of the discrete holes. The roll shell 720 has an annular raised surface 721 which is precisely ground smooth, flat and perpendicular to the roll shell 720 axis. This is the surface which contacts the air bearing 723 surface until air pressure is applied to the air passage 727 at which time a film of high pressure air exists between the two surfaces and the air bearing 723 is physically separated from the roll land area 721 by the thickness of the pressurized air film between the two parts. The roll hub 726 is supported on a machine frame by a support mount 729. The air bearing 723 is rigidly attached to the hub 726 and as it is attached to the stationary roll mount 729, the air bearing 723 is held stationary while the roll shell 720 and the integral bearing land area 721 rotate. All of the component parts of the roll assembly 730 are initially assembled to establish the fit characteristics of the whole unit. Then the roll assembly 720 is partially disassembled to allow installation of the abrasive grinding material such as the abrasive sheet annular disk 722. A pressure sensitive adhesive (PSA) backside coated annular ring of abrasive coated plastic backing 722 is cut out and attached to the roll annular ring 721 by the PSA bonding action. The abrasive side of the abrasive annular disk 722 faces the air bearing 723 and the roll then is reassembled. Then a force 728 of from 0.1 to 10 lbs. is applied to the roll assembly 730 while the roll mount 729 is attached to a rigid base and the roll is rotated from 10 to 5,000 RPM on one or both clockwise and counter clockwise directions. No air pressure is applied to the thrust air bearing 723 which allows the abrasive particles of the abrasive disk 722 to be in contact with the face of the air bearing 723 while the roll 720 is rotating. Air pressure is supplied to the radial support bearings 724 to both allow the roll to be easily rotated and also to position the roll in its operating location when developing the matching ground fit in the bearing gap. The axial force 728 may also be accompanied by other roll forces which would represent roll operational forces which may slightly reposition the roll 720 relative to the axial thrust bearing 723 during the grinding operation. This abrasive action grinds or laps a small amount of material off from the face of the air bearing 723 until it is flat and parallel with the roll contact land area 721. For a porous carbon thrust air bearing, it is desired to use 0.5 to 20 micron 3M diamond particle coated sheet abrasive for effective grinding of the porous carbon while leaving a smooth 1 to 10 micro inch finish on the surface of the porous carbon with this abrasive.

Once the thrust bearing 723 surface has been match ground, then the roll assembly 730 is taken apart, the abrasive disk 722 removed, the component parts cleaned of grinding debris and the roll reassembled for operation. If desired, the roll land area 721 can also be reground for flatness and smoothness to make it perpendicular to the roll axis or to repair defects by the same process. Many of the roll assembly 730 component parts are very hard as they are constructed of rust proof materials such as stainless steel, hard chrome plated steel and so on to resist corrosion caused by moisture content in the compressed inlet air. These materials are hard to grind so the abrasives are selected carefully to match the material being ground. To grind the roll land area 721, an annular disk of abrasive 722 can be attached with the use of PSA adhesive to the ground surface of the thrust air bearing 723 so that the abrasive surface of the abrasive disk 722 faces the exposed surface of the roll raised annular ring 721. The same grinding procedure as described here is employed to regrind the annular ring surface. In this way, one bearing component surface can be ground, and if desired, the process may be continued to alternatively and sequentially grind these surfaces in multiple steps or stages.

An alternative not shown here is to substitute a different type of abrasive such as loose dry abrasive particles on an abrasive wet slurry for the coated abrasive annular sheet. Loose abrasive will mutually grind both the stationary and the rotating elements of a thrust air bearing to develop a high quality matching fit of the two bearing components. Here, either the surface of the air bearing 723 on the roll land area 721 would be coated with abrasive and then the grinding action completed. The roll air bearing land area 721 is raised from the end surface of the roll shell 720 for two reasons. One reason is to make it easier for the precision of the roll end grinding to be focused only on the air bearing 723 contact surface and to eliminate the requirement to precisely grind the whole end of the roll which would add extra unnecessary cost to manufacturing. Also, it is easier to present a grinding head to the roll end if the land area 721 is located some distance away in a radial direction of the roll shaft 725.

What is claimed:

1. A movable shaft with a low friction support for said movable shaft comprising a housing, and within said housing:

a shaft;

at least one fluid bearing adjacent a surface of said shaft;

a source of fluid at a pressure of at least 16.7 psi into said at least one fluid bearing;

at least one vent for carrying fluid from said at least one fluid bearing away from said shaft to a reduced pressure area;

at least one fluid pressure chamber at one end of said shaft, said fluid pressure chamber being able to provide fluid pressure that provides a force along an axial direction of said shaft to move said shaft axially.

2. The shaft of claim 1 wherein said vent carries air as said fluid from said at least one fluid bearing to an ambient environment.

3. The movable shaft of claim 1 wherein said at least one bearing comprises a continuous bearing or at least one pair of opposed air bearings.

4. The moveable shaft of claim 3 wherein at least two pairs of air bearings comprise said at least one air bearing.

5. The moveable shaft of claim 4 wherein at least one vent is present between said at least two air bearings.

6. The moveable shaft of claim 4 wherein at least one fluid vent is provided between said at least two pairs of opposed fluid bearings.

7. The moveable shaft of claim 3 wherein an adjustable orifice exhaust vent is fluid conductively connected to said pressure chamber.

8. The moveable shaft of claim 7 wherein a pressure regulator regulates air pressure such that air pressure present at a cross sectional area of the shaft produces a shaft force that prevents movement of the shaft in an axial direction or causes movement of said shaft in an axial direction.

9. The moveable shaft of claim 1 wherein the at least one fluid bearing is selected from the group consisting of porous carbon and porous graphite air bearings to support the shaft on a film of air.

10. The moveable shaft of claim 1 wherein the fluid bearing comprises an air bearing comprising orifice jets with orifice diameters ranging from 0.001 to 0.010 inches to support the shaft on a film of air.

11. The moveable shaft of claim 1 wherein liquid is provided to said at least one fluid bearing to support said shaft.

12. The moveable shaft of claim 1 wherein a pulsating pressure source is provided to said at least one fluid bearing, said pulsating pressure source changing the applied pressure to the fluid bearings by a factor of at least 5% at frequency range of at least 5 Hertz.

13. The moveable shaft of claim 1 wherein a vacuum source of between 1 and 29 inches mercury is connected to an end of said shaft within said pressure chamber to generate a negative withdrawal or retraction force.

14. The moveable shaft of claim 1 wherein said shaft has a non-uniform shaft.

15. The moveable shaft of claim 1 wherein a shaft is used which has a hollow piston rod end located at the pressure chamber, and said piston rod end is sealed.

16. A web dancer system comprising the moveable shaft of claim 1 having two ends, one end having said shaft project from the housing, and the other end of said housing being pivotably fixed to a surface, the shaft projecting from said housing being connected to a pivot arm.

17. The web dancer system of claim 16 wherein said pivot arm has a first end and a second end, and said first end of said pivot arm pivots about a bearing.

18. The web dancer system of claim 17 wherein said second end of said pivot arm is connected to a roller.

19. The web dancer system of claim 18 wherein at least one of said bearing and said roller comprises an air bearing or air bearing supported roller.

20. The web dancer system of claim 18 wherein the roller comprises air bearings supporting a dead-shaft idler roll at both ends.

21. The web dancer system of claim 16 wherein the air bearing is selected from the group consisting of porous carbon and porous graphite air bearings to support the piston shaft on a film of air.

22. The web dancer system of claim 16 wherein the air bearing comprises a precision jeweled orifice jets with orifice diameters ranging from 0.001 to 0.010 inches to support the shaft on a film of air.

23. A web dancer system comprising the moveable shaft of claim 1 having two ends, one end having said shaft project from the housing, and the other end of said housing being pivotably fixed to a surface, the shaft projecting from said housing being connected to an air bearing slide.

24. A roller comprising:

a) a shaft secured to a roller shell, said shaft extending out from both ends of the roller shell;

b) hubs at each end of said shaft, each hub with air bearings within each hub adjacent to said shaft to support radial force loads on said shaft;

c) at least one hub having a spherical ball contacting ends of said shaft within at least one hub thrust surface air bearing on the end of each roll shaft.

25. The roller of claim 24 wherein pressurized air is provided to said air bearings through ports in said hub.

26. The roller of claim 25 wherein said pressurized air is provided through a port that enters the hub along an axial path.

27. The roller of claim 24 wherein said air bearings are selected from the group consisting of porous carbon air bearings, porous graphite air bearings, and orifice jets with orifice diameters ranging from 0.001 to 0.010 inches.

28. The roller of claim 24 wherein said spherical ball also contacts an air bearing surface.

29. The roller of claim 28 wherein said air bearing surface has an indentation that accepts said spherical ball.

30. A roller comprising:

a) a shaft secured to a roller shell, said shaft extending out from both ends of the roller shell;

b) hubs at each end of said shaft, each hub with porous air bearings having porous material or orifices with diameters comprising from 0.001 to 0.010 inches providing air into the air bearings in the hubs within each hub adjacent to said shaft to support radial forces loaded on said shaft;

c) at least one hub having an axial movement restraint system selected from the group consisting of a flat surface air bearing contact with a shaft end and a flat surface air bearing contact with an end of said roller.

31. The roller of claim 30 wherein within said hub is at least one spring axially attached to said roller or said shaft.

32. The roller of claim 30 wherein gas fluid passages are provided through said hub, and said gas fluid passages are gas conductively connected to both air bearings adjacent said shaft and said flat surface contact air bearing.

33. The roller of claim 32 wherein an entry gas fluid passage to said gas fluid passages comprises an axially oriented passage.

34. The roller of claim 33 wherein said entry gas fluid passage is approximately concentric with said shaft.

35. The roller of claim 30 wherein said hub has a hub shaft extending away from said shaft, and a split spherical collar supporting the hub shaft to a brace so that the hub shaft and split spherical collar may rotate within said brace.

36. The roller of claim 35 wherein said brace may be tightened about the split spherical collar to reduce the ability of the split collar to move within the brace.

37. The roller of claim 30 wherein the porous air bearing comprises an air bearing having a porous carbon surface through which air is provided.

38. The roller of claim 30 wherein air is provided into the air bearing through said orifices.

39. A low friction roller comprising:

a hollow roller body;

an extension of said hollow roller body, a shaft fixed to said hollow roller body, a hub surrounding said shaft;

an air bearing system supporting said shaft within said hub each hub with porous air bearings having porous material or orifices with diameters comprising from 0.001 to 0.010 inches providing air into the air bearings in the hubs within each hub;

said hub having an external surface facing away from said roller;

said extension of said roller having removable retainers extending inwardly;

said removable retainers extending radially beyond outer limits of said external surface of said hub, so that if said roller body shifts axially with respect to said hub, said removable retainers will limit movement of said roller body with respect to said hub.

* * * * *